US010336963B2

(12) United States Patent
Burrington et al.

(10) Patent No.: US 10,336,963 B2
(45) Date of Patent: Jul. 2, 2019

(54) AROMATIC TETRAHEDRAL BORATE COMPOUNDS FOR LUBRICATING COMPOSITIONS

(71) Applicant: THE LUBRIZOL CORPORATION, Wickliffe, OH (US)

(72) Inventors: James D. Burrington, Wickliffe, OH (US); Ewan Delbridge, Wickliffe, OH (US); Yanshi Zhang, Wickliffe, OH (US); John K. Pudelski, Wickliffe, OH (US)

(73) Assignee: THE LUBRIZOL CORPORATION, Wickliffe, OH (US)

( * ) Notice: Subject to any disclaimer, the term of this patent is extended or adjusted under 35 U.S.C. 154(b) by 0 days.

(21) Appl. No.: 15/551,106

(22) PCT Filed: Feb. 25, 2016

(86) PCT No.: PCT/US2016/019532

§ 371 (c)(1),
(2) Date: Aug. 15, 2017

(87) PCT Pub. No.: WO2016/138248

PCT Pub. Date: Sep. 1, 2016

(65) Prior Publication Data

US 2018/0030369 A1 Feb. 1, 2018

Related U.S. Application Data

(60) Provisional application No. 62/121,052, filed on Feb. 26, 2015.

(51) Int. Cl.

| | |
|---|---|
| ***C10M 139/00*** | (2006.01) |
| ***C10M 169/04*** | (2006.01) |
| ***C10M 105/00*** | (2006.01) |
| ***C10M 149/10*** | (2006.01) |
| ***C10M 161/00*** | (2006.01) |

(52) U.S. Cl.

CPC ..... *C10M 169/044* (2013.01); *C10M 105/00* (2013.01); *C10M 139/00* (2013.01); *C10M 149/10* (2013.01); *C10M 161/00* (2013.01); *C10M 2207/024* (2013.01); *C10M 2207/144* (2013.01); *C10M 2217/028* (2013.01); *C10M 2227/061* (2013.01); *C10M 2227/062* (2013.01); *C10N 2220/04* (2013.01); *C10N 2230/04* (2013.01); *C10N 2230/041* (2013.01); *C10N 2230/10* (2013.01); *C10N 2230/12* (2013.01); *C10N 2230/36* (2013.01); *C10N 2230/52* (2013.01); *C10N 2240/04* (2013.01);

(Continued)

(58) Field of Classification Search

CPC ..... C10M 139/00; C10M 2227/06; C10M 2227/061

USPC ..... 508/187, 199, 200

See application file for complete search history.

(56) References Cited

U.S. PATENT DOCUMENTS

| | | | |
|---|---|---|---|
| 1,975,890 | A | 10/1934 | Williams et al. |
| 2,497,521 | A | 2/1950 | Trautman |

(Continued)

FOREIGN PATENT DOCUMENTS

| | | | |
|---|---|---|---|
| EP | 0 355 895 | A | 2/1990 |
| WO | WO 2008/147704 | | 12/2008 |
| WO | WO 2012/128714 | A1 | 9/2012 |
| WO | WO 2015/195614 | A1 | 12/2015 |
| WO | WO 2016/138227 | | 2/2016 |

OTHER PUBLICATIONS

Gusain, et al., "Halogen-free imidazolium/ammonium-bis(salicylato)borate ionic liquids as high performance lubricant additives," RSC Advances: An International Journal to Further the Chemical Sciences, vol. 4, No. 3, pp. 1293-1301 (2014).

Gusain, et al., "Halogen-free Bis(imidazolium/Bis(ammonium)-Di[bis(salicylate)borate] Ionic Liquids As Energy-Efficient and Environmentally Friendly Lubricant Additives," ACS Applied Materials & Interfaces, pp. 15318-15328 (2014).

Yang, et al., "Syntheses, structures and properties of three nonmetal borates with salicylic acid and organic amines," Inorg. Chim. Acta 365 (1), pp. 20-24 (2011).

(Continued)

*Primary Examiner* — Ellen M McAvoy

(74) *Attorney, Agent, or Firm* — Ann Skerry; Iken Sans

(57) ABSTRACT

A lubricating composition includes an oil of lubricating viscosity and an ionic tetrahedral borate compound which includes a cation and a tetrahedral borate anion which includes a boron atom, the boron atom having at least one aromatic bidentate di-oxo ligand. The compound may be represented by formula (I), where $R^1$ and $R^2$ are selected from $C_{1-48}$ hydrocarbyl groups or together form a substituted or unsubstituted 5- or 6-membered ring; $R^3$ and $R^4$ together represent a substituted or unsubstituted aromatic ring; m is 0 or 1; X is hydrogen, a $C_{1-24}$ hydrocarbyl group, —$OR^5$, —$NHR^5$, or =O, $R^5$ is a $C_{1-24}$ hydrocarbyl group; M represents the cation; and n is at least 1. The cation may be selected to provide detergent and/or dispersant properties to the lubricating composition. In the case of ammonium cations, the molecular weight may be 260 g/mol or higher for providing a highly soluble compound, particularly when X is =O.

(I)

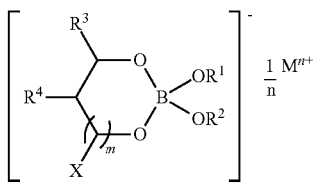

22 Claims, No Drawings

(52) U.S. Cl.
CPC ..... *C10N 2240/08* (2013.01); *C10N 2240/10* (2013.01); *C10N 2240/102* (2013.01)

(56) References Cited

U.S. PATENT DOCUMENTS

| | | | | |
|---|---|---|---|---|
| 2,795,548 | A | 6/1957 | Thomas et al. | |
| 2,883,412 | A | 4/1959 | Warren | |
| 2,902,450 | A | 9/1959 | Warren | |
| 3,172,892 | A | 3/1965 | Le Suer | |
| 3,185,644 | A | 5/1965 | Knowles et al. | |
| 3,197,405 | A | 7/1965 | Le Suer et al. | |
| 3,219,666 | A | 11/1965 | Norman et al. | |
| 3,316,177 | A | 4/1967 | Dorer, Jr. | |
| 3,340,281 | A | 9/1967 | Brannen, Jr. et al. | |
| 3,351,552 | A | 11/1967 | Le Suer et al. | |
| 3,381,022 | A | 4/1968 | Le Suer et al. | |
| RE26,433 | E | 8/1968 | Le Suer | |
| 3,433,744 | A | 3/1969 | Le Suer et al. | |
| 3,444,170 | A | 5/1969 | Norman et al. | |
| 3,467,668 | A | 9/1969 | Gruber et al. | |
| 3,501,405 | A | 3/1970 | Willette et al. | |
| 3,542,680 | A | 11/1970 | Le Suer et al. | |
| 3,576,743 | A | 4/1971 | Widmer et al. | |
| 3,632,511 | A | 1/1972 | Liao et al. | |
| 4,234,435 | A | 11/1980 | Meinhardt et al. | |
| 4,265,664 | A | 5/1981 | Saischek et al. | |
| 4,511,516 | A | 4/1985 | Holstedt et al. | |
| 4,629,578 | A | 12/1986 | Liston | |
| 4,655,948 | A * | 4/1987 | Doner | C07F 5/04 508/189 |
| 4,778,612 | A | 10/1988 | Wirth et al. | |
| 5,102,569 | A | 4/1992 | Onopchenko et al. | |
| 5,147,914 | A | 9/1992 | Horacek et al. | |
| 5,160,650 | A * | 11/1992 | Small, Jr. | C07F 5/04 508/189 |
| 5,160,651 | A | 11/1992 | Small, Jr. et al. | |
| 5,221,758 | A | 6/1993 | Maynard | |
| 5,284,594 | A | 2/1994 | Small, Jr. et al. | |
| 6,153,565 | A | 11/2000 | Skinner et al. | |
| 6,165,235 | A | 12/2000 | Kolp et al. | |
| 6,228,818 | B1 * | 5/2001 | Schwind | C07F 9/091 508/187 |
| 6,281,179 | B1 | 8/2001 | Skinner et al. | |
| 6,329,327 | B1 | 12/2001 | Tanaka et al. | |
| 6,429,178 | B1 | 8/2002 | Skinner et al. | |
| 6,429,179 | B1 | 8/2002 | Skinner et al. | |
| 6,559,105 | B2 | 5/2003 | Abraham et al. | |
| 6,914,037 | B2 | 7/2005 | Gatto | |
| 7,116,724 | B2 | 10/2006 | You | |
| 7,238,650 | B2 | 7/2007 | Calder et al. | |
| 7,285,516 | B2 | 10/2007 | Carrick et al. | |
| 7,423,000 | B2 | 9/2008 | Williamson et al. | |
| 7,582,126 | B2 | 9/2009 | Martyak et al. | |
| 7,727,943 | B2 | 6/2010 | Brown et al. | |
| 9,518,243 | B2 * | 12/2016 | Antzutkin | C10M 105/78 |
| 2002/0147116 | A1 * | 10/2002 | Carrick | C10M 139/00 508/198 |
| 2004/0007693 | A1 | 1/2004 | Moulton et al. | |
| 2005/0065045 | A1 | 3/2005 | Wilk et al. | |
| 2005/0198894 | A1 | 9/2005 | Migdal et al. | |
| 2006/0014651 | A1 | 1/2006 | Esche et al. | |
| 2006/0019838 | A1 * | 1/2006 | Muir | C10L 1/303 508/198 |
| 2006/0079413 | A1 | 4/2006 | Kocsis et al. | |
| 2006/0183647 | A1 | 8/2006 | Kocsis et al. | |
| 2008/0119378 | A1 | 5/2008 | Gandon et al. | |
| 2008/0171677 | A1 | 7/2008 | Buck et al. | |
| 2008/0280795 | A1 | 11/2008 | Fujitsu et al. | |
| 2009/0054278 | A1 | 2/2009 | Baumanis et al. | |
| 2010/0081592 | A1 | 4/2010 | Kocsis et al. | |
| 2010/0197536 | A1 | 8/2010 | Mosier et al. | |
| 2014/0011720 | A1 | 1/2014 | Antzutkin et al. | |
| 2016/0215204 | A1 | 7/2016 | Chang et al. | |

OTHER PUBLICATIONS

Fu, et al., "Bis(dimethylammonium)mer-tris(salicylato-$k^2O,O^1$)titanate(IV)" *Acta Cryst.* E61, m1730-m1732 (2005). (Abstract only).

* cited by examiner

AROMATIC TETRAHEDRAL BORATE COMPOUNDS FOR LUBRICATING COMPOSITIONS

This application claims the benefit of PCT/US2016/019532, filed on Feb. 25, 2016, and U.S. Provisional Application No. 62/121,052, filed on Feb. 26, 2015, from which the PCT application claims priority, the disclosures of which are incorporated herein by reference in their entireties.

BACKGROUND

The exemplary embodiment relates to lubricant additives and in particular to ionic borate compounds useful in lubricating compositions.

Thermal and mechanical stresses on lubricants, such as engine and driveline oils, tend to increase the tendency towards formation of deposits on the lubricated components, such as internal combustion engines and driveline components. This can negatively impact the performance of the lubricated components through reduction in engine efficiency or overall life-expectancy. Such lubricants generally incorporate, in addition to a base oil, a number of additives, including friction modifiers, antiwear agents, antioxidants, dispersants, and detergents, that are used to protect lubricated components from wear, oxidation, soot deposits, corrosion, acid build up, and the like, and to improve water tolerance and compatibility of formulation components.

Dispersants are used for dispersing impurities such as wear particles, soot and other contaminants. Amine-based dispersants, such as polyamine succinimides, have been widely used. These dispersants often have basic functionality which can help to neutralize acidic contaminants. However, they have a tendency to reduce corrosion protection and seals compatibility.

Salicylate and catecholate additives have been used to provide desirable performance attributes to lubricant formulations, including cleanliness, antioxidancy, and dispersancy.

U.S. Pat. Nos. 7,423,000 and 7,582,126 disclose compositions containing catechol compounds, such as tertiary alkyl substituted catechols.

Borate-based additives are also known to provide desirable attributes, including corrosion resistance, antioxidancy, water tolerance and compatibility.

U.S. Pat. No. 5,102,569 discloses borated alkyl aromatic polyols for use in lubricating oil formulations to reduce oxidation, wear, and deposits in internal combustion engines. U.S. Pat. Nos. 2,795,548 and 5,284,594 disclose lubricating oil compositions containing a borated alkyl catechol. U.S. Pub. No. 20080171677 discloses a lubricating oil composition which includes a borated hydroxyl ester, such as borated glycerol monooleate.

The exemplary ionic borate compounds provide lubricating compositions with good dispersion and/or detergent properties while reducing and/or limiting detrimental effects commonly associated with basic amine additive containing lubricants, such as poor seal compatibility, deposit formation, and reduced corrosion protection.

BRIEF DESCRIPTION

In accordance with one aspect of the exemplary embodiment, a lubricating composition includes an oil of lubricating viscosity and an ionic tetrahedral borate compound comprising a cation and a tetrahedral borate anion which comprises a boron atom, the boron atom having at least one aromatic bidentate di-oxo ligand. When the cation is an ammonium cation, the ammonium cation may have a molecular weight of at least 260 g/mol, such as at least 300 g/mol.

In accordance with another aspect of the exemplary embodiment, a method of forming a lubricating composition includes reacting a 1,2- or 1,3-dioxo chelate with a trivalent borate compound and a basic component to form a reaction product, the basic component providing the reaction product with a total base number of at least 5, and combining the reaction product with an oil of lubricating viscosity. Where the basic component is an amine, it may have a molecular weight of at least 260 g/mol.

In accordance with another aspect of the exemplary embodiment, a lubricating composition includes an oil of lubricating viscosity and an ionic tetrahedral borate compound which is a reaction product of a 1,2- or 1,3-dioxo chelate, a trivalent borate compound, and a basic component which provides the reaction product with a total base number of at least 5, wherein at least a portion of the boron in the mixture is converted to a tetravalent borate anion.

In accordance with another aspect of the exemplary embodiment, a lubricating composition includes an oil of lubricating viscosity and a combination and/or reaction product of a trivalent borate compound, a 1,2- or 1,3-dioxo chelate, and an alkyl amine having at least two $C_8$ or higher alkyl groups.

DETAILED DESCRIPTION

Aspects of the exemplary embodiment relate to a lubricating composition, a method of lubrication, and a use of the lubricating composition.

The exemplary lubricating composition includes an oil of lubricating viscosity (or "base oil"), and an ionic borate compound which can serve as a dispersant or detergent in the lubricating composition.

The ionic borate compound may be present in the lubricating composition at a total concentration of at least 0.01 wt. %, or at least 0.1 wt. %, or at least 0.6 wt. %, or at least 1 wt. %. The ionic borate compound may be present in the lubricating composition at a total concentration of up to 10 wt. %, or up to 8 wt. %, or up to 5 wt. %, or up to 3.5 wt. %.

A. The Ionic Borate Compound

The exemplary ionic borate compound includes at least one four-coordinate borate anion and a cation serving as the counter ion in the compound. The four-coordinate borate anion includes a boron atom which is directly attached to four oxygen atoms (a $BO_4^-$ unit). The borate ion may be tetrahedral. In a tetrahedral borate ion, the configuration of the $BO_4^-$ unit is tetrahedral, rather than planar. This structure can be achieved by forming the ionic borate compound in basic conditions.

The borate anion includes at least one aromatic bidentate di-oxo ligand. In some embodiments, the borate anion includes two aromatic bidentate di-oxo ligands. Each aromatic bidentate di-oxo ligand forms a chelate with the boron atom through its two oxo groups (—O—) forming a ring which includes —O—B—O—. The boron-containing ring is directly attached to an aromatic group, such as an optionally substituted five or six-membered aromatic ring.

The ionic tetrahedral borate compound may be represented by the general structure shown in Formula I:

Formula I

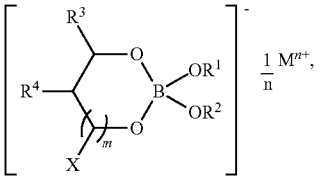

where $R^1$ and $R^2$ are independently selected from hydrocarbyl groups of 1 to 48 carbon atoms or taken together, form a substituted or unsubstituted 5- or 6-membered ring;

$R^3$ and $R^4$ taken together represent a substituted or unsubstituted aromatic ring (that may be substituted with one or more hydrocarbyl groups of 1 to 32 carbon atoms);

m is 0 or 1;

X is selected from hydrogen, a hydrocarbyl group of 1 to 24 carbon atoms, —$OR^5$, —$NHR^5$, =O, and mixtures thereof;

$R^5$ is a hydrocarbyl group of 1 to 24 carbon atoms;

M represents the cation; and n is an integer, i.e., at least 1, and can be up to 7, or up to 4.

For convenience, the borate anion of Formula I may be represented as [B].

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. By predominantly hydrocarbon character, it is meant that at least 70% or at least 80% of the atoms in the substituent are hydrogen or carbon.

Examples of hydrocarbyl groups include:

(i) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

(ii) substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

(iii) hetero substituents, that is, substituents which, while having a predominantly hydrocarbon character, may contain other than carbon in a ring or chain otherwise composed of carbon atoms.

Representative alkyl groups include n-butyl, iso-butyl, sec-butyl, n-pentyl, amyl, neopentyl, n-hexyl, n-heptyl, secondary heptyl, n-octyl, secondary octyl, 2-ethyl hexyl, n-nonyl, secondary nonyl, undecyl, secondary undecyl, dodecyl, secondary dodecyl, tridecyl, secondary tridecyl, tetradecyl, secondary tetradecyl, hexadecyl, secondary hexadecyl, stearyl, icosyl, docosyl, tetracosyl, 2-butyloctyl, 2-butyldecyl, 2-hexyloctyl, 2-hexydecyl, 2-octyldecyl, 2-hexydodecyl, 2-octyldodecyl, 2-decyltetradecyl, 2-dodecylhexadecyl, 2-hexyldecyloctyldecyl, 2-tetradecyloctyldecy, monomethyl branched-isostearyl, and the like.

Representative aryl groups include phenyl, toluyl, xylyl, cumenyl, mesityl, benzyl, phenethyl, styryl, cinnamyl, benzahydryl, trityl, ethyiphenyl, propylphenyl, butylphenyl, pentyiphenyl, hexylphenyl, heptyiphenyl, octylphenyl, nonyiphenyl, decylphenyl, undecylphenyl, dodecylphenyl benzylphenyl, styrenated phenyl, p-cumylphenyl, α-naphthyl, β-naphthyl groups, and mixtures thereof.

Heteroatoms include sulfur, oxygen, nitrogen, and encompass substituents as pyridyl, furyl, thienyl and imidazolyl. In general, no more than two, and in one embodiment, no more than one, non-hydrocarbon substituent will be present for every ten carbon atoms in the hydrocarbyl group. In some embodiments, there are no non-hydrocarbon substituents in the hydrocarbyl group.

In Formula I, $R^1$ and $R^2$ may be independently selected from hydrocarbyl groups of 1 to 48 carbon atoms. Alternatively, $R^1$ and $R^2$, in combination, may form a substituted or unsubstituted 5-membered or 6-membered ring. In the case of $R^1$ and $R^2$ forming a substituted 5-membered or 6-membered ring, the substituents may be selected from aliphatic hydrocarbyl groups, aromatic hydrocarbyl groups, which may include one or two heteroatoms, and combinations thereof.

In some embodiments, $R^1$ and $R^2$ together form a substituted or unsubstituted 5-membered or 6-membered ring, wherein the substituted or unsubstituted 5- or 6-membered ring includes 1 or 2 heteroatoms. The substituted 5-membered or 6-membered ring formed by $R^1$ and $R^2$ may be substituted with at least one substituent selected from aliphatic hydrocarbyl groups, aromatic hydrocarbyl groups, aliphatic hydrocarbyl groups comprising at least one heteroatom, aromatic hydrocarbyl groups comprising at least one heteroatom, and combinations thereof.

Example substituted and unsubstituted 5-membered and 6-membered rings which are formed by $R_1$ and $R_2$ include bidentate di-oxo ligands analogous to those which include $R^3$ and $R^4$. In this embodiment, the structure of the tetrahedral borate ion of the borate compound may be represented by the structure shown in Formula II;

Formula II

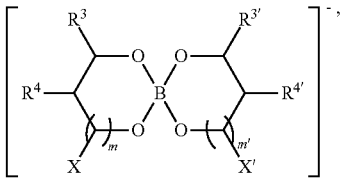

where $R^{3'}$, $R^{4'}$, may be as described for $R^3$, $R^4$, respectively, or may be independently selected from H and hydrocarbyl groups of 1 to 48 carbon atoms; and X' and m' may be as described for X and m, respectively.

In Formulas I and II, $R^3$ and $R^4$, in combination, represent a substituted or unsubstituted aromatic ring. In the case of $R^3$ and $R^4$ representing a substituted aromatic ring, the substituents may include one or more of hydrocarbyl groups of 1 to 32 carbon atoms, hydroxide groups, alkoxy groups, and combinations thereof. Example alkoxy groups useful herein include methoxy, ethoxy and the like.

When m is 0, the bidentate di-oxo ligand, the tetrahedral borate ion may be represented by the structure shown in Formula III:

Formula III

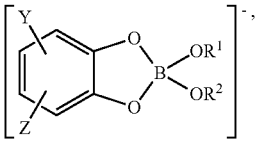

where Y and Z are independently selected from hydrogen, a hydrocarbyl group of 1 to 24 carbon atoms, —$OR^5$, —$NHR^5$, =O, —OH, and mixtures thereof.

In some embodiments, the tetrahedral borate ion of Formula III may be a catecholate, which may be derived from catechol or a derivative thereof. The tetrahedral borate ion may be represented by the structure shown in Formula IV:

Formula IV

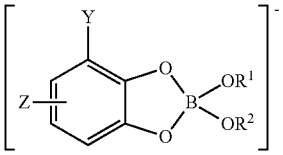

where Y, Z, $R^1$ and $R^2$ are as defined above. In one embodiment, Z is selected from hydrogen and a hydrocarbyl group of from 1 to 24 carbon atoms, as defined above.

In one embodiment, In the case where m is 1 in Formula I or II, the tetrahedral borate ion may be represented by the structure shown in Formula V:

Formula V

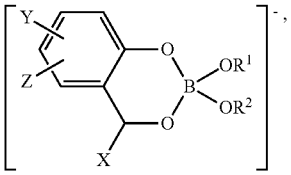

where X, Y, Z, $R^1$ and $R^2$ are as defined above.

X', where present, is selected from hydrogen, a hydrocarbyl group of 1 to 24 carbon atoms, as described above, —$OR^5$ (alkoxy), —$NHR^5$ (amino), where $R^5$ is a hydrocarbyl group of 1 to 24 carbon atoms, or =O (oxo), as for X, m', where present, can also be 1. The borate ion can include mixtures of these species. As an example, when m is 1 and X is =O, the bidentate di-oxo ligand may be salicylate, which is derived from salicylic acid or a derivative thereof. The tetrahedral borate ion may then be represented by the structure shown in Formula VI:

Formula VI

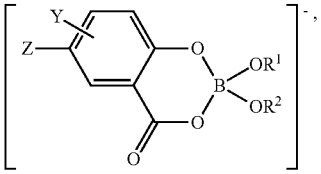

where Y, Z, $R^1$ and $R^2$ are as described above.

Ionic borates derived from salicylates can provide detergency and thus can replace some or all of a conventional detergent which may otherwise be present in the lubricating composition.

As will be appreciated, when the four-coordinate borate anion includes two bidentate di-oxo ligands —$OR^1$ and —$OR^2$ may form a bidentate di-oxo ligand which is the same as described for the bidentate di-oxo ligand which includes $R^3$ and $R^4$, or may be different. For example, the borate anion may include two aromatic bidentate di-oxo ligands attached to the same boron atom. An example borate anion of this type where both bidentate ligands are aromatic and where m is 1 may be represented by the structure shown in Formula VII:

Formula VII

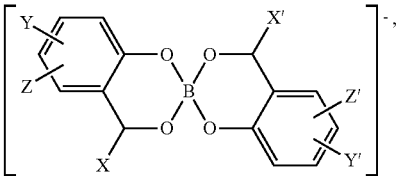

where Y, Z, X and X' are as defined above and Y' and Z' can be as defined for Y and Z, respectively.

In one embodiment, Z and Z' are independently selected from H and hydrocarbyl groups of 1 to 24 carbon atoms. In one embodiment, each of Y, Z, Y' and Z' is independently a hydrocarbyl group of from 1 to 24 carbon atoms. In one embodiment X and X' are both =O. In one embodiment, Z and Z' are at the furthest position on the aromatic ring from the nearest oxygen.

In another embodiment, the borate anion may include one organic bidentate di-oxo ligand and one aliphatic bidentate di-oxo ligand attached to the same boron atom. For example, $OR^1$ and $OR^2$ may be the reaction product of an aliphatic α-, β-, or γ-diol or hydroxyacid.

In the tetrahedral borate compound of Formula I, M represents the conjugate cation (and is also the conjugate cation for the anions in Formulas II-VII). Exemplary cations M can include metal cations, ammonium cations, phosphonium cations, ash-free organic cations (some of which may also be ammonium cations or phosphonium cations), and mixtures thereof.

Exemplary metal cations include alkali metal cations, alkaline earth metal cations, transition metal cations, and combinations thereof. Examples of metal cations include $Li^+$, $Na^+$, $K^+$, $Rb^+$, $Cs^+$, $Be^{2+}$, $Mg^{2+}$, $Ca^{2+}$, $Sr^{2+}$, $Ba^{2+}$, $Sc^{3+}$, $Sc^{2+}$, $Sc^+$, $Y^{3+}$, $Y^{2+}$, $Ti^{4+}$, $Ti^{3+}$, $Ti^{2+}$, $Zr^{4+}$, $Zr^{3+}$, $Zr^{2+}$, $Hf^{4+}$, $Hf^{3+}$, $V^{4+}$, $V^{3+}$, $V^{2+}$, $Nb^{4+}$, $Nb^{3+}$, $Nb^{2+}$, $Ta^{4+}$, $Ta^{3+}$, $Ta^{2+}$, $Cr^{4+}$, $Cr^{3+}$, $Cr^{2+}$, $Cr^+$, $Mo^{4+}$, $Mo^{3+}$, $Mo^{2+}$, $Mo^+$, $W^{4+}$, $W^{3+}$, $W^{2+}$, $W^+$, $Mn^{4+}$, $Mn^{3+}$, $Mn^{2+}$, $Mn^+$, $Re^{4+}$, $Re^{3+}$, $Re^{2+}$, $Re^+$, $Fe^{6+}$, $Fe^{4+}$, $Fe^{3+}$, $Fe^{2+}$, $Fe^+$, $Ru^{4+}$, $Ru^{3+}$, $Ru^{2+}$, $Os^{4+}$, $Os^{3+}$, $Os^{2+}$, $Os^+$, $Co^{5+}$, $Co^{4+}$, $Co^{3+}$, $Co^{2+}$, $Co^+$, $Rh^{4+}$, $Ru^{3+}$, $Rh^{2+}$, $Rh^+$, $Ir^{4+}$, $Ir^{3+}$, $Ir^{2+}$, $Ir^+$, $Ni^{3+}$, $Ni^{2+}$, $Ni^+$, $Pd^{4+}$, $Pd^{2+}$, $Pd^+$, $Pt^{4+}$, $Pt^{2+}$, $Pt^+$, $Cu^{4+}$, $Cu^{3+}$, $Cu^{2+}$, $Cu^+$, $Ag^{3+}$, $Ag^{2+}$, $Ag^+$, $Au^{4+}$, $Au^{3+}$, $Au^{2+}$, $Au^+$, $Zn^{2+}$, $Zn^+$, $Cd^{2+}$, $Cd^+$, $Hg^{4+}$, $Hg^{2+}$, $Hg^+$, $Al^{3+}$, $Al^{2+}$, $Al^+$, $Ga^{3+}$, $Ga_+$, $In^{3+}$, $In^{2+}$, $Tl^{3+}$, $Tl^+$, $Si^{4+}$, $Si^{3+}$, $Si^{2+}$, $Si^+$, $Ge^{4+}$, $Ge^{3+}$, $Ge^{2+}$, $Ge^+$, $Sn^{4+}$, $Sn^{2+}$, $Pb^{4+}$, $Pb^{2+}$, $As^{3+}$, $As^{2+}$, $As^+$, $Sb^{3+}$, $Bi^{3+}$, $Te^{4+}$, $Te^{2+}$, $La^{3+}$, $La^{2+}$, $Ce^{4+}$, $Ce^{3+}$, $Ce^{2+}$, $Pr^{4+}$, $Pr^{3+}$, $Pr^{2+}$, $Nd^{3+}$, $Nd^{2+}$, $Sm^{3+}$, $Sm^{2+}$, $Eu^{3+}$, $Eu^{2+}$, $Gd^{3+}$, $Gd^{2+}$, $Gd^+$, $Tb^{4+}$, $Tb^{3+}$, $Tb^{2+}$, $Tb^+$, $Db^{3+}$, $Db^+_+$, $Ho^{3+}$, $Er^{3+}$, $Tm^{4+}$, $Tm^{3+}$, $Tm^{2+}$, $Yb^{3+}$, $Yb^{2+}$, and $Lu^{3+}$. Particularly useful are those which form stable salts, i.e., which do not decompose by more than a minor amount over the expected lifetime and operating conditions of the lubricating composition.

An ash-fee (ashless) organic cation is an organic ion that does not contain ash-forming metals.

Example ammonium cations are of the general form $N(R^{11}R^{12}R^{13}R^{14})^+$ where $R^{11}$, $R^{12}$, $R^{13}$, $R^{14}$ can independently be H or a hydrocarbyl group, as described above. Any two of $R^{11}$, $R^{12}$, $R^{13}$, $R^{14}$ may also be two ends of a single carbon chain wherein the amine is part of a cyclic structure. In one embodiment, the ammonium cation is an unsubstituted ammonium cation ($NH_4^+$). In another embodiment, $R^{11}$ is H and one or more of $R^{12}$, $R^{13}$, $R^{14}$ is a hydrocarbyl group.

When the cation is an ammonium cation derived from an amine or ammonium compound, the ammonium cation (or the amine from which it is derived) may have molecular weight of at least 260 g/mol, or at least 300 g/mol or at least 350 g/mol, or at least 500 g/mol. The solubility of the compound is increased, allowing the concentration of the ionic borate compound in the lubricating composition to be at least 0.5 wt. %, or at least 1 wt. %, or at least 1.5 wt. %, or at least 2 wt. % or at least 4.5 wt. %.

The ammonium cation may be derived from a mono-, di-, or tri-substituted amine, which may be branched or unbranched. Each alkyl group may independently have, for example, from 1-32, or 1-24, or 1-12, or 1-8 carbon atoms and in some embodiments, at least one or at least two of the alkyl groups may have at least 6 or at least 8 carbon atoms. Specific examples include primary alkylamines, such as methylamine, ethylamine, n-propylamine, n-butylamine, n-hexylamine, n-octylamine, 2-ethylhexylamine, benzylamine, 2-phenylethylamine, cocoamine, oleylamine, and tridecylamine (CAS#86089-17-0); secondary and tertiary alkylamines such as isopropylamine, sec-butylamine, t-butylamine, cyclopentylamine, cyclohexylamine, and 1-phenylethylamine; dialkylamines, such as dimethylamine, diethylamine, dipropylamine, diisopropylamine, dibutylamine, dicyclohexylamine, di-(2-ethylhexyl)amine, dihexylamine, ethylbutylamine, N-ethylcyclohexylamine, and N-methylcyclohexylamine; cycloalkylamines, such as piperidine, N-ethylpiperidine, N,N'-dimethylpiperazine, morpholine, N-methylmorpholine, N-ethylmorpholine, N-methylpiperidine, pyrrolidine, N-methylpyrrolidine, and N-ethylpyrrolidine; trialkylamines, such as trimethylamine, triethylamine, tripropylamine, triisopropylamine, tributylamines, such as tri-n-butylamine, trihexylamines, triheptylamines, trioctylamines, such as tris(2-ethylhexyl)amine, N,N-dimethylbenzylamine, dimethylethylamine, dimethylisopropylamine, dimethylbutylamine, and N,N-dimethylcyclohexylamine.

When the ammonium ion includes at least one hydrocarbyl group (a quaternary ammonium ion), the ammonium cation may be an ashless organic ion. Example ammonium cations of this type include N-substituted long chain alkenyl succinimides and aliphatic polyamines. N-substituted long chain alkenyl succinimides useful herein may be derived from an aliphatic polyamine, or mixture thereof. The aliphatic polyamine may be aliphatic polyamine such as an ethylenepolyamine, a propylenepolyamine, a butylenepolyamine, or mixture thereof. Examples of N-substituted long chain alkenyl succinimides include polyisobutylene succinimide with number average molecular weight of the polyisobutylene substituent of at least 350, or at least 500, or at least 550, or at least 750, and can be up to 5000, or up to 3000, or up to 2500. Such succinimides can be formed, for example, from high vinylidene polyisobutylene and maleic anhydride.

Example N-substituted long chain alkenyl succinimides useful herein as ammonium cations include those derived from succinimide dispersants, which are more fully described in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, 7,238,650 and EP Patent Application 0 355 895 A.

Example aliphatic polyamines useful as the ammonium ion include ethylenepolyamines, propylenepolyamines, butylenepolyamines, and mixtures thereof. Example ethylenepolyamines include ethylenediamine, diethylenetriamine, triethylenetetramine, tetraethylenepentamine, pentaethylene-hexamine, polyamine still bottoms, and mixtures thereof.

Example phosphonium cations are of the general form $P(R^{14}R^{15}R^{16}R^{17})^+$ where $R^{14}$, $R^{15}$, $R^{16}$, $R^{17}$ are independently a hydrocarbyl group, as described above. When the phosphonium cation includes at least one hydrocarbyl group, the phosphonium cation may be an ashless organic ion.

Total base number (TBN) is the quantity of acid, expressed in terms of the equivalent number of milligrams of potassium hydroxide (meq KOH), that is required to neutralize all basic constituents present in 1 gram of a sample of the lubricating oil. The TBN may be determined according to ASTM Standard D2896-11, "Standard Test Method for Base Number of Petroleum Products by Potentiometric Perchloric Acid Titration" (2011), ASTM International, West Conshohocken, Pa., 2003 DOI: 10.1520/D2896-11 (hereinafter, "D2896").

The cation may serve as a basic component of the lubricating composition which, in combination with any basic components which have not formed a chelate with the bidentate di-oxo ligand, may provide the ionic borate compound/reaction mixture and/or lubricating composition with a total base number of at least 5, or at least 8, or at least 10, or at least 15, or at least 25, as measured by D2896. The cation itself may have a TBN of at least 10 or at least or at least 15, or at least 25, or at least 50 as measured by D2896. Unless otherwise noted, TBN is as determined by this method.

The ability of a compound to deliver TBN as measured by both ASTM D4739-11 ("Standard Test Method for Base Number Determination by Potentiometric Hydrochloric Acid Titration," DOI: 10.1520/D4739-11, hereinafter, "D4739") and D2896 may be desired. Many amines deliver TBN as measured by D2896 but not as measured by D4739. In one embodiment, the cation TBN is measured by both D4739 and D2896. In one embodiment, the reaction product has a TBN as measured by D4739 of at least 5, or at least 10, or at least 15. Compounds which are amine salts of an amine having a molecular weight of at least 260 g/mol (or where the cation has such a molecular weight) are particularly useful in providing a lubricating composition with a high TBN.

Particularly in the case of salicylates (e.g., as in Formula VI, or in formula VII, when X is =O), when the cation is derived from an amine or ammonium compound, cation, or the amine or ammonium compound from which the cation is derived, may have molecular weight of at least 260 g/mol, or at least 350, or at least 500 g/mol.

Specific examples of such amine and ammonium compounds which have molecular weight of at least 260 g/mol include polyisobutylene derived succinimide dispersants wherein the polyisobutylene may be 1000 Mn and the succinimide amine is a polyethylenepolyamine (Mn 1700 g/mol); decylanthranilate (Mn 277 g/mol); nonylated diphenylamine (Mn~300 g/mol); N,N-dicocoamine (Mn~380 g/mol); tetrabutylammonium; Mannich amines (0404.1/2); trimethylcetylammonium, and combinations thereof.

In some embodiments, the ionic borate compound is metal free and thus excludes metal cations or includes them in a trace amount which does not appreciable affect the character of the composition, such as at a total of less than 5 mole %, or less than 1 mole % of the cations M present in the ionic borate compound.

In some embodiments, the ionic borate compound includes at least one second anion, the second anion being an anion other than a four-coordinate borate anion, as described above. The borate compound may thus be of the general form:

$$[B]^{-}_{n-pq}M^{n+}([A]^{q-})_p$$

where $[A]^{31}$ represents the second anion, q≥1, p≥1, and n−pq≥1.

For example, the cation M may be a metal cation, such as $Ca^{2+}$ and the second anion may be a sulfonate anion ($R^{20}SO_2O^-$), where $R^{20}$ can be a hydrocarbyl group, as described above; alkylsalicylates; phenates; salixarates; saligenins; glyoxylates; aliphatic carboxylates, and combinations thereof.

B. Oil of Lubricating Viscosity

The lubricating composition may include the oil of lubricating viscosity as a minor or major component thereof, such as at least 5 wt. %, or at least 10 wt. %, or at least 20 wt. %, or at least 30 wt. %, or at least 40 wt. %, or at least 60 wt. %, or at least 80 wt. % of the lubricating composition.

Suitable oils include natural and synthetic oils, oil derived from hydrocracking, hydrogenation, and hydrofinishing, unrefined, refined, re-refined oils or mixtures thereof. Unrefined, refined and re-refined oils, and natural and synthetic oils are described, for example, in WO2008/47704 and US Pub. No. 2010/197536. Synthetic oils may also be produced by Fischer-Tropsch reactions and typically may be hydroisomerized Fischer-Tropsch hydrocarbons or waxes. Oils may be prepared by a Fischer-Tropsch gas-to-liquid synthetic procedure as well as other gas-to-liquid procedures.

Oils of lubricating viscosity may also be defined as specified in April 2008 version of "Appendix E-API Base Oil Interchangeability Guidelines for Passenger Car Motor Oils and Diesel Engine Oils", section 1.3 Sub-heading 1.3. "Base Stock Categories". The API Guidelines are also summarized in U.S. Pat. No. 7,285,516. The five base oil groups are as follows: Group I (sulfur content <0.03 wt. %, and/or <90 wt. % saturates, viscosity index 80-120); Group II (sulfur content ≤0.03 wt. %, and ≥90 wt. % saturates, viscosity index 80-120); Group III (sulfur content ≤0.03 wt. %, and ≥90 wt. % saturates, viscosity index ≥120); Group IV (all polyalphaolefins (PAOs)); and Group V (all others not included in Groups I, II, III, or IV). The exemplary oil of lubricating viscosity includes an API Group I, Group II, Group III, Group IV, Group V oil, or mixtures thereof. In some embodiments, the oil of lubricating viscosity is an API Group I, Group II, Group III, or Group IV oil, or mixtures thereof. In some embodiments, the oil of lubricating viscosity is an API Group I, Group II, or Group III oil, or mixture thereof. In one embodiment the oil of lubricating viscosity may be an API Group II, Group III mineral oil, a Group IV synthetic oil, or mixture thereof. In some embodiments, at least 5 wt. %, or at least 10 wt. %, or at least 20 wt. %, or at least 40 wt. % of the lubricating composition is a polyalphaolefin (Group IV).

The oil of lubricating viscosity may have a kinematic viscosity of up to 30 $mm^2/s$ or up to 15 $mm^2/s$ (cSt) at 100° C. and can be at least 15 $mm^2/s$ at 100° C., and in other embodiments 1-12 or 2-10 or 3-8 or 4-6 $mm^2/s$. As used herein, kinematic viscosity is determined at 100° C. by ASTM D445-14, "Standard Test Method for Kinematic Viscosity of Transparent and Opaque Liquids (and Calculation of Dynamic Viscosity)," ASTM International, West Conshohocken, Pa., 2003, DOI: 10.1520/D0445-14 ad may be referred to as KV_100. The dispersant viscosity modifier may have a KV_100 of at least 35 $mm^2/s$, or at least 100 $mm^2/s$, or at least 500 $mm^2/s$.

In certain embodiments, the lubricating composition may contain synthetic ester base fluids. Synthetic esters may have a kinematic viscosity measured at 100° C. of 2.5 $mm^2/s$ to 30 $mm^2/s$. In one embodiment, the lubricating composition comprises less than 50 wt. % of a synthetic ester base fluid with a KV_100 of at least 5.5 $mm^2/s$, or at least 6 $mm^2/s$, or at least 8 $mm^2/s$.

Exemplary synthetic oils include poly-alpha olefins, polyesters, polyacrylates, and poly-methacrylates, and co-polymers thereof. Example synthetic esters include esters of a dicarboxylic acid (e.g., selected from phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, and alkenyl malonic acids) with an alcohol (e.g., selected from butyl alcohol, hexyl alcohol, dodecyl alcohol, 2-ethylhexyl alcohol, ethylene glycol, diethylene glycol monoether, and propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and from polyol ethers such as neopentyl glycol, trimethylolpropane, pentaerythritol, dipentaerythritol, and tripentaerythritol. Esters can also be monoesters, such as are available under the trade name Priolube 1976™ ($C_{18}$-alkyl-COO—$C_{20}$ alkyl).

Synthetic ester base oils may be present in the lubricating composition of the invention in an amount less than 50 wt. % of the composition, or less than 40 weight %, or less than 35 weight %, or less than 28 weight %, or less than 21 weight %, or less than 17 weight %, or less than 10 weight %, or less than 5 weight % of the composition. In one embodiment, the lubricating composition of the invention is free of, or substantially free of, a synthetic ester base fluid having a KV_100 of at least 5.5 $mm^2/s$.

Example natural oils include animal and vegetable oils, such as long chain fatty acid esters. Examples include linseed oil, sunflower oil, sesame seed oil, beef tallow oil, lard oil, palm oil, castor oil, cottonseed oil, corn oil, peanut oil, soybean oil, olive oil, whale oil, menhaden oil, sardine oil, coconut oil, palm kernel oil, babassu oil, rape oil, and soya oil.

The amount of the oil of lubricating viscosity present is typically the balance remaining after subtracting from 100 weight % the sum of the amount of the exemplary ionic borate compound and the other performance additives.

The lubricating composition may be in the form of a concentrate and/or a fully formulated lubricant. If the lubricating composition (comprising the ionic borate compound disclosed herein) is in the form of a concentrate which may be combined with additional oil to form, in whole or in part, a finished lubricant, the ratio of ionic borate compound to the oil of lubricating viscosity may be in the range, by weight, of 0.1:99.9 to 99:1, or 1:99 to 90:10, or 10:90 to 80:20.

The lubricating composition comprising the ionic borate compound may have a kinematic viscosity of 2 cSt to 20 cSt at 100° C., as measured by ASTM D445-14. The lubricating composition is liquid, i.e., not a gel or semi-solid, at ambient temperatures (5-30° C.).

Method of Forming the Composition

A lubricating composition may be prepared by adding the ionic borate compound to an oil of lubricating viscosity, optionally in the presence of other performance additives (as described herein below), or by adding reagents for forming the ionic borate compound to an oil of lubricating viscosity or suitable diluent so that the ionic borate compound is formed in situ.

The ionic borate compound may be formed in basic conditions. Basic conditions are such that compounds that are basic, as determined by D2896, are present in sufficient quantity to react with acidic (i.e., abstractable) protons on the borate complex to allow formation of the tetrahedral complex.

In one embodiment, to form the ionic borate compound, a 1,2- or 1,3-dioxo chelate capable of forming an aromatic bidentate di-oxo ligand is combined with a trivalent boron compound and a counterion in sufficient amount to convert some or all of the aromatic diol to the ionic borate compound. The reactants may be combined in the oil of lubricating viscosity.

The ionic borate compound includes the 1,2- or 1,3-dioxo chelate, trivalent borate compound, and counterion charge in a molar ratio of about 2:1:1. A molar ratio of the 1,2- or 1,3-dioxo chelate to trivalent borate compound used in forming the combination and/or reaction product may be from 4:1 to 1:2, such as from 2:1 to 1:2, and the molar ratio of the trivalent borate compound to counterion (e.g., alkyl amine) used in forming the combination and/or reaction product may be from 1:2 to 2:1.

Suitable 1,2- and 1,3-dioxo chelates include aromatic 1,2-diols and aromatic. hydroxyacids, such as salicylic acid, alkylated salicylates, catechol, and derivatives thereof. These can be substituted as discussed above for X, Y and Z. For example, the chelate may be selected from salicylic acid, catechol, and derivatives thereof where the aromatic ring is substituted with one or more $C_1$-$C_{32}$ alkyl groups.

Suitable catechols include unsubstituted, mono-substituted, di-substituted, and tri-substituted catechols. Exemplary catechols are of formula:

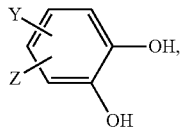

where Y and Z are as defined above.

Examples include:

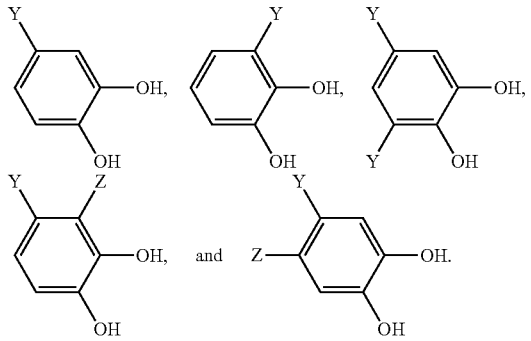

As examples of substituted catechols, alkyl catechols which may be employed include decyl catechol, undecyl, catechol, dodecyl catechol, tetradecyl catechol, pentadecyl catechol, hexadecyl catechol, octadecyl catechol, eicosyl catechol, hexacosyl catechol, triacontyl catechol, and mixtures thereof. Trialkyl catechols may also be employed.

Suitable salicylates include unsubstituted, mono-substituted, di-substituted, and tri-substituted salicylates. Exemplary salicylates are of the general formula:

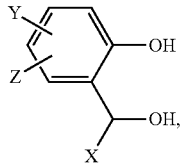

where X, Y, and Z are as defined above.

In one embodiment, X is =O.

Tri-substituted salicylic acid derivatives are also contemplated.

As examples of substituted salicylic acid derivatives, alkyl salicylic acid derivatives which may be employed include 4-alkyl salicylic acids, 6-alkyl salicylic acids, 4,6-dialkylsalicylic acids, or combinations thereof, wherein the alkyl group may be a hydrocarbyl group of 1 to 50 carbon atoms and mixtures thereof. Examples of suitable alkylsalicylic acids include 4-(tetrapropenyl)salicylic acid, 6-tetrapropenylsalicylic acid, and mixtures thereof.

Alkyl catechols and salicylates may be prepared by reacting a $C_{10}$-$C_{48}$ olefin, such as a branched olefin or straight-chain alpha olefin containing 10 to 48 carbon atoms or mixtures thereof with catechol or salicylic acid in the presence of a sulfonic acid catalyst at a temperature of from about 60° C. to 200° C., such as 125° C. to 180° C., and in one embodiment, from 130° C. to 150° C., optionally in the presence of in an essentially inert solvent, at atmospheric pressure. Although alkylation of catechol can be carried in the absence of solvents, the use of solvents, particularly in a batch reactor greatly facilitates the process due to better contact of the reactants, improved filtration, etc. Examples of the inert solvents include benzene, toluene, chlorobenzene and mixtures of aromatics, paraffins and/or naphthenes.

In the exemplary embodiment, there is sufficient diol or hydroxyacid present such that at least a portion of the trivalent boron compound reacts with 4 hydroxyl groups present in the reaction mixture to form an ion. A ratio by weight of boron in the form of trivalent borate compound to boron in the tetrahedral borate compound in the resulting lubricating composition may be at least 80:20, or at least 90:10, or at least 95:5. In some embodiments, up to 5% of the boron in the mixture is converted from the trivalent boron to tetravalent borate anion.

Suitable trivalent boron compounds include borate esters, boric acid, and derivatives thereof. Examples of borate esters and acids are of the general form $B(OR)_3$ where each R is independently selected from H and hydrocarbyl groups of 1 to 48 carbon atoms. Examples include boric acid, borated hydroxyl esters, such as borated glycerol monooleate (GMO), borated glycerol dioleate (GDO), borated glycerol trioleate (GTO), borated glycerol monococoate (GMC), borated monotalloate (GMT), borated glycerol mono-sorbitate (GMS), borated polyol esters with pendant hydroxyl groups, such as borated pentaerythritol di-$C_8$ ester, tri-hydroxyl orthoborates, borated dispersants, such as borated succinimides, borated detergents, and combinations thereof.

In one embodiment, the counter ion is a basic component, such as a dispersant or detergent with provides the reaction product with a total base number (TBN) of at least 5 (meq KOH/g). The source of the counter ion may be an aminic dispersant or a detergent wherein the TBN is at least 5. For solubilization in mineral oil, particular examples include polyisobutenyl succinimide and polyamine dispersants with high N:CO ratios and with a TBN of at least 5 (mg KOH/g), such as at least 10, or at least 25, and solubilized fatty acid amines, such as stearyl or oleyl amine. Examples of detergent counter ions include overbased and neutral calcium, magnesium or sodium sulfonates, phenates, salicylates, and other detergents know to those skilled in the art.

In one embodiment, the ionic borate compound is the reaction product of salicylic acid or its derivatives, b) a borate ester, boric acid, or derivative and c) a basic component, such as a dispersant or detergent, to form a "boro-salicylated" dispersant or detergent.

In one embodiment, the ionic borate compound is the reaction product of catechol or its derivatives, b) a borate ester, boric acid, or derivative thereof, and c) a basic component, such as a dispersant or detergent, to form a "boro-catecholated" dispersant or detergent.

In one specific embodiment, the ionic borate compound is the reaction product of catechol or its derivatives, b) a borate ester, boric acid, or derivative, and c) a an alkyl amine, such as an alkyl amine containing at least one or at least two $C_8$ or higher alkyl group(s).

These materials can enhance the positive attributes of the three components, while minimizing the negative impact on corrosion and seals degradation. In addition, the combination of these materials can also provide enhancement in durability of performance, that is, the maintenance of positive effects further into the service interval than might otherwise be expected from the individual components.

The lubricating composition may further include additional performance additives, such as detergents, antioxidants, additional dispersants, antiwear agents, and friction modifiers.

The lubricating composition formed by the exemplary method can thus be a mixture of reactants and their reaction products, such as a mixture of:

a) a 1,2- or 1,3-dioxo chelate, such as a hydroxyacid, glycerol monooleate, salicylic acid or derivative, catechol or derivative, or mixture thereof;

b) boric acid, a borate ester or other trivalent borate derivative, c) a basic component such as an aminic dispersant or a detergent wherein the total base number is at least 5 meq KOH/g;

d) other performance additives, and e) an oil of lubricating viscosity.

The tetrahedral borate complexes described herein may be formed in a suitable solvent or as a neat reaction of components, some of which may contain some amount of diluent oil. Formation of the complex is readily achieved at temperatures between 65° C. and 120° C., such as 80° C. to 100° C. In one embodiment, the reaction may be carried out under reduced atmosphere to facilitate removal of alcohol by-product.

C. Other Performance Additives

In addition to the exemplary ionic boron compound(s) disclosed herein, the lubricating composition may further include one or more of the following additional performance additives: detergents, antioxidants, dispersants, viscosity modifiers, antiwear/antiscuffing agents, metal deactivators, friction modifiers, extreme pressure agents, foam inhibitors, demulsifiers, pour point depressants, corrosion inhibitors, seal swelling agents, and the like.

Detergents

The lubricating composition optionally further includes at least one detergent. Exemplary detergents useful herein include overbased metal-containing detergents. The metal of the metal-containing detergent may be zinc, sodium, calcium, barium, or magnesium. The overbased metal-containing detergent may be chosen from sulfonates, non-sulfur containing phenates, sulfur containing phenates, salixarates, salicylates, and mixtures thereof, or borated equivalents thereof. The overbased detergent may be borated with a borating agent such as boric acid.

The overbased metal-containing detergent may also include "hybrid" detergents formed with mixed surfactant systems including phenate and/or sulfonate components, e.g., phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where a hybrid sulfonate/phenate detergent is employed, the hybrid detergent can be considered equivalent to amounts of distinct phenate and sulfonate detergents introducing like amounts of phenate and sulfonate soaps, respectively.

Example overbased metal-containing detergents include zinc, sodium, calcium and magnesium salts of sulfonates, phenates (including sulfur-containing and non-sulfur containing phenates), salixarates and salicylates. Such overbased sulfonates, salixarates, phenates and salicylates may have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Typically, an overbased metal-containing detergent may be a zinc, sodium, calcium or magnesium salt of a sulfonate, a phenate, sulfur containing phenate, salixarate or salicylate. Overbased sulfonates, salixarates, phenates and salicylates typically have a total base number of 120 to 700 TBN. Overbased sulfonates typically have a total base number of 120 to 700, or 250 to 600, or 300 to 500 (on an oil free basis).

The overbased sulfonate detergent may have a metal ratio of 12 to less than 20, or 12 to 18, or 20 to 30, or 22 to 25.

Example sulfonate detergents include linear and branched alkylbenzene sulfonate detergents, and mixtures thereof, which may have a metal ratio of at least 8, as described, for example, in U.S. Pub. No. 2005065045. Linear alkyl benzenes may have the benzene ring attached anywhere on the linear chain, usually at the 2, 3, or 4 position, or be mixtures thereof. Linear alkylbenzene sulfonate detergents may be particularly useful for assisting in improving fuel economy.

In one embodiment, the alkylbenzene sulfonate detergent may be a branched alkylbenzene sulfonate, a linear alkylbenzene sulfonate, or mixtures thereof.

In one embodiment, the lubricating composition may be free of linear alkylbenzene sulfonate detergent. The sulfonate detergent may be a metal salt of one or more oil-soluble alkyl toluene sulfonate compounds as disclosed in U.S. Pub. No. 20080119378.

The lubricating composition may include at least 0.01 wt. % or at least 0.1 wt. %, detergent, and in some embodiments, up to 2 wt. %, or up to 1 wt. % detergent. Branched alkylbenzenesulfonate detergents may be present in the lubricating composition at 0.1 to 3 wt. %, or 0.25 to 1.5 wt. %, or 0.5 to 1.1 wt. %.

Antioxidants

The lubricating composition optionally further includes at least one antioxidant. Exemplary antioxidants useful herein include phenolic and aminic antioxidants, such as diarylamines, alkylated diarylamines, hindered phenols, and mixtures thereof. The diarylamine or alkylated diarylamine may be a phenyl-α-naphthylamine (PANA), an alkylated diphenylamine, an alkylated phenylnapthylamine, or mixture thereof. Example alkylated diphenylamines include dinonyl diphenylamine, nonyl diphenylamine, octyl diphenylamine, dioctyl diphenylamine, didecyl diphenylamine, decyl diphenylamine, and mixtures thereof. Example alkylated diarylamines include octyl, dioctyl, nonyl, dinonyl, decyl and didecyl phenylnapthylamines.

Hindered phenol antioxidants often contain a secondary butyl and/or a tertiary butyl group as a steric hindering group. The phenol group may be further substituted with a hydrocarbyl group (e.g., a linear or branched alkyl) and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol, 4-butyl-2,6-di-tert-butylphenol, and 4-dodecyl-2,6-di-tert-butylphenol. In one embodiment, the hindered phenol antioxidant may be an ester, such as those described in U.S. Pat. No. 6,559,105. One such hindered phenol ester is sold as Irganox™ L-135, obtainable from Ciba.

When present, the lubricating composition may include at least 0.1 wt. % or at least 0.5 wt. %, or at least 1 wt. % antioxidant, and in some embodiments, up to 3 wt. %, or up to 2.75 wt. %, or up to 2.5 wt. % antioxidant.

Dispersants

The lubricating composition optionally further includes at least one dispersant other than the exemplary compound. Exemplary dispersants include succinimide dispersants, Mannich dispersants, succinamide dispersants, and polyolefin succinic acid esters, amides, and ester-amides, and mixtures thereof. The succinimide dispersant, where present, may be as described above for the succinimides described as useful for cation M.

The succinimide dispersant may be derived from an aliphatic polyamine, or mixtures thereof. The aliphatic polyamine may be an ethylenepolyamine, a propylenepolyamine, a butylenepolyamine, or a mixture thereof. In one embodiment the aliphatic polyamine may be an ethylenepolyamine. In one embodiment the aliphatic polyamine may be chosen from ethylenediamine, diethylenetriamine, triethylenetetramine, tetra¬ ethylene¬ pentamine, pentaethylenehexamine, polyamine still bottoms, and mixtures thereof.

In one embodiment the dispersant may be a polyolefin succinic acid ester, amide, or ester-amide. A polyolefin succinic acid ester-amide may be a polyisobutylene succinic acid reacted with an alcohol (such as pentaerythritol) and a polyamine as described above. Example polyolefin succinic acid esters include polyisobutylene succinic acid esters of pentaerythritol and mixture thereof.

The dispersant may be an N-substituted long chain alkenyl succinimide. An example of an N-substituted long chain alkenyl succinimide is polyisobutylene succinimide. Typically the polyisobutylene from which polyisobutylene succinic anhydride is derived has a number average molecular weight of 350 to 5000, or 550 to 3000 or 750 to 2500. Succinimide dispersants and their preparation are disclosed, for example, in U.S. Pat. Nos. 3,172,892, 3,219,666, 3,316,177, 3,340,281, 3,351,552, 3,381,022, 3,433,744, 3,444,170, 3,467,668, 3,501,405, 3,542,680, 3,576,743, 3,632,511, 4,234,435, Re 26,433, and 6,165,235, and 7,238,650 and EP Patent Application 0 355 895 A.

The succinimide dispersant may comprise a polyisobutylene succinimide, wherein the polyisobutylene from which polyisobutylene succinimide is derived has a number average molecular weight of 350 to 5000, or 750 to 2500.

The exemplary dispersants may also be post-treated by conventional methods by a reaction with any of a variety of agents. Among these are boron compounds (such as boric acid), urea, thiourea, dimercaptothiadiazoles, carbon disulfide, aldehydes, ketones, carboxylic acids such as terephthalic acid, hydrocarbon-substituted succinic anhydrides, maleic anhydride, nitriles, epoxides, and phosphorus compounds. In one embodiment the post-treated dispersant is borated. In one embodiment the post-treated dispersant is reacted with dimercaptothiadiazoles. In one embodiment the post-treated dispersant is reacted with phosphoric or phosphorous acid. In one embodiment the post-treated dispersant is reacted with terephthalic acid and boric acid (as described in U.S. Pub. No. 2009/0054278.

When present, the lubricating composition may include at least 0.01 wt. %, or at least 0.1 wt. %, or at least 0.5 wt. %, or at least 1 wt. % dispersant, and in some embodiments, up to 20 wt. %, or up to 15 wt. %, or up to 10 wt. %, or up to 6 wt. % or up to 3 wt. % dispersant.

Anti-Wear Agents

The lubricating composition optionally further includes at least one antiwear agent. Examples of suitable antiwear agents suitable for use herein include titanium compounds, tartrates, tartrimides, oil soluble amine salts of phosphorus compounds, sulfurized olefins, metal dihydrocarbyldithiophosphates (such as zinc dialkyldithiophosphates), phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The antiwear agent may in one embodiment include a tartrate, or tartrimide as described in U.S. Pub. Nos. 2006/0079413; 2006/0183647; and 2010/0081592. The tartrate or tartrimide may contain alkyl-ester groups, where the sum of carbon atoms on the alkyl groups is at least 8. The antiwear agent may, in one embodiment, include a citrate as is disclosed in US Pub. No. 20050198894.

The lubricating composition may in one embodiment further include a phosphorus-containing antiwear agent. Example phosphorus-containing antiwear agents include zinc dialkyldithiophosphates, phosphites, phosphates, phosphonates, and ammonium phosphate salts, and mixtures thereof.

When present, the lubricating composition may include at least 0.01 wt. %, or at least 0.1 wt. %, or at least 0.5 wt. % antiwear agent, and in some embodiments, up to 3 wt. %, or up to 1.5 wt. %, or up to 0.9 wt. antiwear agent.

Oil-Soluble Titanium Compounds

The lubricating composition may include one or more oil-soluble titanium compounds, which may function as antiwear agents, friction modifiers, antioxidants, deposit control additives, or more than one of these functions. Example oil-soluble titanium compounds are disclosed in U.S. Pat. No. 7,727,943 and U.S. Pub. No. 2006/0014651. Example oil soluble titanium compounds include titanium (IV) alkoxides, such as titanium (IV) isopropoxide and titanium (IV) 2 ethylhexoxide. Such alkoxides may be formed from a monohydric alcohol, a vicinal 1,2-diol, a polyol, or mixture thereof. The monohydric alkoxides may have 2 to 16, or 3 to 10 carbon atoms. In one embodiment, the titanium compound comprises the alkoxide of a vicinal 1,2-diol or polyol. 1,2-vicinal diols include fatty acid monoesters of glycerol, where the fatty acid may be, for example, oleic acid. Other example oil soluble titanium compounds include titanium carboxylates, such as titanium neodecanoate.

When present in the lubricating composition, the amount of oil-soluble titanium compounds is included as part of the antiwear agent.

Extreme Pressure (EP) Agents

The lubricating composition may include an extreme pressure agent. Example extreme pressure agents that are soluble in the oil include sulfur- and chlorosulfur-containing EP agents, dimercaptothiadiazole or $CS_2$ derivatives of dispersants (typically succinimide dispersants), derivative of chlorinated hydrocarbon EP agents and phosphorus EP agents. Examples of such EP agents include chlorinated wax; sulfurized olefins (such as sulfurized isobutylene), hydrocarbyl-substituted 2,5-dimercapto-1,3,4-thiadiazoles and oligomers thereof, organic sulfides and polysulfides, such as dibenzyldisulfide, bis-(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters, such as dihydrocarbon and trihydrocarbon phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenol phosphite; metal thiocarbamates, such as zinc dioctyldithiocarbamate and barium heptylphenol diacid; amine salts of alkyl and dialkylphosphoric acids or derivatives including, for example, the amine salt of a reaction product of a dialkyldithiophosphoric acid with propylene oxide and subsequently followed by a further reaction with $P_2O_5$; and mixtures thereof. Some useful extreme pressure agents are described in U.S. Pat. No. 3,197,405.

When present, the lubricating composition may include at least 0.01 wt %, or at least 0.1 wt. %, or at least 0.5 wt. % extreme pressure agent, and in some embodiments, up to 3 wt. %, or up to 1.5 wt. %, or up to 0.9 wt. % of the extreme pressure agent.

Foam Inhibitors

The lubricating composition may include a foam inhibitor. Foam inhibitors that may be useful in the lubricant composition include polysiloxanes; copolymers of ethyl acrylate and 2-ethylhexylacrylate and optionally vinyl acetate; demulsifiers including fluorinated polysiloxanes, Wally, phosphates, polyethylene glycols, polyethylene oxides, polypropylene oxides and (ethylene oxide-propylene oxide) polymers.

Viscosity Modifiers

The lubricating composition may include a viscosity modifier. Viscosity modifiers (also sometimes referred to as viscosity index improvers or viscosity improvers) useful in the lubricant composition are usually polymers, including polyisobutenes, polymethacrylates (PMA) and polymethacrylic acid esters, diene polymers, polyalkylstyrenes, esterified styrene-maleic anhydride copolymers, hydrogenated alkenylarene-conjugated diene copolymers and polyolefins also referred to as olefin copolymer or OCP. PMA's are prepared from mixtures of methacrylate monomers having different alkyl groups. The alkyl groups may be either straight chain or branched chain groups containing from 1 to 18 carbon atoms. Most PMA's are viscosity modifiers as well as pour point depressants. In one embodiment, the viscosity modifier is a polyolefin comprising ethylene and one or more higher olefin, such as propylene.

When present, the lubricating composition may include at least 0.01 wt. %, or at least 0.1 wt. %, or at least 0.3 wt. %, or at least 0.5 wt. % polymeric viscosity modifiers, and in some embodiments, up to 10 wt. %, or up to 5 wt. %, or up to 2.5 wt. % polymeric viscosity modifiers.

Corrosion Inhibitors and Metal Deactivators

The lubricating composition may include a corrosion inhibitor. Corrosion inhibitors/metal deactivators that may be useful in the exemplary lubricating composition include fatty amines, octylamine octanoate, condensation products of dodecenyl succinic acid or anhydride, and a fatty acid such as oleic acid with a polyamine, derivatives of benzotriazoles (e.g., tolyltriazole), 1,2,4-triazoles, benzimidazoles, 2-alkyldithiobenzimidazoles and 2-alkyldithiobenzothiazoles.

Pour Point Depressants

The lubricating composition may include a pour point depressant. Pour point depressants that may be useful in the exemplary lubricating composition include polyalphaolefins, esters of maleic anhydride-styrene copolymers, polymethacrylates, polyacrylates, and polyacrylamides.

Friction Modifiers

The lubricating composition may include a friction modifier. Friction modifiers that may be useful in the exemplary lubricating composition include fatty acid derivatives such as amines, esters, epoxides, fatty imidazolines, condensation products of carboxylic acids and polyalkylene-polyamines and amine salts of alkylphosphoric acids.

The friction modifier may be an ash-free friction modifier. Such friction modifiers are those which typically not produce any sulfated ash when subjected to the conditions of ASTM D 874. An additive is referred to as "non-metal containing" if it does not contribute metal content to the lubricant composition. As used herein the term "fatty alkyl" or "fatty" in relation to friction modifiers means a carbon chain having 8 to 30 carbon atoms, typically a straight carbon chain.

In one embodiment ash-free friction modifier may be represented by the formula

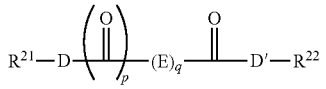

where, D and D' are independently selected from —O—, >NH, >$NR^{23}$, an imide group formed by taking together both D and D' groups and forming a $R^{21}$—N<group between two >C═O groups; E is selected from —$R^{24}$—

O—$R^{25}$—, >$CH_2$, >$CHR^{26}$, >$CR^{26}R^{27}$, >$C(OH)(CO_2R^{22})$, >$C(CO_2R^{22})_2$, and >$CHOR^{28}$; where $R^{24}$ and $R^{25}$ are independently selected from >$CH_2$, >$CHR^{26}$, >$CR^{26}R^{27}$, >$C(OH)(CO_2R^{22})$, and >$CHOR^{28}$; q is 0 to 10, with the proviso that when q=1, E is not >$CH_2$, and when n=2, both Es are not >$CH_2$; p is 0 or 1; $R^{21}$ is independently hydrogen or a hydrocarbyl group, typically containing 1 to 150 carbon atoms, with the proviso that when $R^{21}$ is hydrogen, p is 0, and q is more than or equal to 1; $R^{22}$ is a hydrocarbyl group, typically containing 1 to 150 carbon atoms; $R^{23}$, $R^{24}$, $R^{25}$, $R^{26}$ and $R^{27}$ are independently hydrocarbyl groups; and $R^{28}$ is hydrogen or a hydrocarbyl group, typically containing 1 to 150 carbon atoms, or 4 to 32 carbon atoms, or 8 to 24 carbon atoms. In certain embodiments, the hydrocarbyl groups $R^{23}$, $R^{24}$, and $R^{25}$, may be linear or predominantly linear alkyl groups.

In certain embodiments, the ash-free friction modifier is a fatty ester, amide, or imide of various hydroxy-carboxylic acids, such as tartaric acid, malic acid lactic acid, glycolic acid, and mandelic acid. Examples of suitable materials include tartaric acid di(2-ethylhexyl)ester (i.e., di(2-ethylhexyl)tartrate), di($C_8$-$C_{10}$)tartrate, di($C_{12}$-$_{15}$)tartrate, dioleyl tartrate, oleyl tartrimide, and oleyl malimide.

In certain embodiments, the ash-free friction modifier may be chosen from long chain fatty acid derivatives of amines, fatty esters, or fatty epoxides; fatty imidazolines such as condensation products of carboxylic acids and polyalkylene-polyamines; amine salts of alkyiphosphoric acids; fatty alkyl tartrates; fatty alkyl tartrimides; fatty alkyl tartramides; fatty phosphonates; fatty phosphites; borated phospholipids, borated fatty epoxides; glycerol esters; borated glycerol esters; fatty amines; alkoxylated fatty amines; borated alkoxylated fatty amines; hydroxyl and polyhydroxy fatty amines including tertiary hydroxy fatty amines; hydroxy alkyl amides; metal salts of fatty acids; metal salts of alkyl salicylates; fatty oxazolines; fatty ethoxylated alcohols; condensation products of carboxylic acids and polyalkylene polyamines; or reaction products from fatty carboxylic acids with guanidine, aminoguanidine, urea, or thiourea and salts thereof.

Friction modifiers may also encompass materials such as sulfurized fatty compounds and olefins, sunflower oil or soybean oil monoester of a polyol and an aliphatic carboxylic acid.

In another embodiment the friction modifier may be a long chain fatty acid ester. In another embodiment the long chain fatty acid ester may be a mono-ester and in another embodiment the long chain fatty acid ester may be a triglyceride.

The amount of the ash-free friction modifier in a lubricant may be 0.1 to 3 percent by weight (or 0.12 to 1.2 or 0.15 to 0.8 percent by weight). The material may also be present in a concentrate, alone or with other additives and with a lesser amount of oil. In a concentrate, the amount of material may be two to ten times the above concentration amounts.

Molybdenum compounds are also known as friction modifiers. The exemplary molybdenum compound does not contain dithiocarbamate moieties or ligands.

Nitrogen-containing molybdenum materials include molybdenum-amine compounds, as described in U.S. Pat. No. 6,329,327, and organomolybdenum compounds made from the reaction of a molybdenum source, fatty oil, and a diamine as described in U.S. Pat. No. 6,914,037. Other molybdenum compounds are disclosed in U.S. Pub. No. 20080280795. Molybdenum amine compounds may be obtained by reacting a compound containing a hexavalent molybdenum atom with a primary, secondary or tertiary amine represented by the formula $NR^{29}R^{30}R^{31}$, where each of $R^{29}$, $R^{30}$ and $R^{31}$ is independently hydrogen or a hydrocarbyl group of 1 to 32 carbon atoms and wherein at least one of $R^{29}$, $R^{30}$ and $R^{31}$ is a hydrocarbyl group of 4 or more carbon atoms or represented by the formula

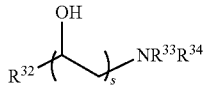

where $R^{32}$ represents a chain hydrocarbyl group having 10 or more carbon atoms, s is 0 or 1, $R^{33}$ and/or $R^{34}$ represents a hydrogen atom, a hydrocarbyl group, an alkanol group or an alkyl amino group having 2 to 4 carbon atoms, and when s=0, both $R^{33}$ and $R^{34}$ are not hydrogen atoms or hydrocarbon groups.

Specific examples of suitable amines include monoalkyl (or alkenyl) amines such as tetradecylamine, stearylamine, oleylamine, beef tallow alkylamine, hardened beef tallow alkylamine, and soybean oil alkylamine; dialkyl(or alkenyl) amines such as N-tetradecylmethylamine, N-pentadecylmethylamine, N-hexadecylmethylamine, N-stearylmethylamine, N-oleylmethylamine, N-dococylmethylamine, N-beef tallow alkyl methylamine, N-hardened beef tallow alkyl methylamine, N-soybean oil alkyl methylamine, ditetradecylamine, dipentadecylamine, dihexadecylamine, distearylamine, dioleylamine, dicocoyl amine, bis(2-hexyldecyl)amine, bis(2-octyldodecyl)amine, bis(2-decyltetradecyl) amine, beef tallow dialkylamine, hardened beef tallow dialkylamine, and soybean oil dialkylamine; and trialk(en) ylamines such as tetradecyldimethylamine, hexadecyldimethylamine, octadecyldimethylamine, beef tallow alkyldimethylamine, hardened beef tallow alkyldimethylamine, soybean oil alkyldimethylamine, dioleylmethylamine, tritetradecylamine, tristearylamine, and trioleylamine. Suitable secondary amines have two alkyl (or alkenyl) groups with 14 to 18 carbon atoms.

Examples of the compound containing the hexavalent molybdenum atom include molybdenum trioxides or hydrates thereof ($MoO_3.nH_2O$), molybdenum acid ($H_2MoO_4$), alkali metal molybdates ($Q_2MoO_4$) wherein Q represents an alkali metal such as sodium and potassium, ammonium molybdates {$(NH_4)_2MoO_4$ or heptamolybdate $(NH_4)_6[Mo_7O_{24}].4H_2O$}, $MoOCl_4$, $MoO_2Cl_2$, $MoO_2Br_2$, $Mo_2O_3Cl_6$ and the like. Molybdenum trioxides or hydrates thereof, molybdenum acid, alkali metal molybdates and ammonium molybdates are often suitable because of their availability. In one embodiment, the lubricating composition comprises molybdenum amine compound.

Other organomolybdenum compounds of the invention may be the reaction products of fatty oils, mono-alkylated alkylene diamines and a molybdenum source. Materials of this sort are generally made in two steps, a first step involving the preparation of an aminoamide/glyceride mixture at high temperature, and a second step involving incorporation of the molybdenum.

Examples of fatty oils that may be used include cottonseed oil, groundnut oil, coconut oil, linseed oil, palm kernel oil, olive oil, corn oil, palm oil, castor oil, rapeseed oil (low or high erucic acids), soyabean oil, sunflower oil, herring oil, sardine oil, and tallow. These fatty oils are generally known as glyceryl esters of fatty acids, triacylglycerols or triglycerides.

Examples of some mono-alkylated alkylene diamines that may be used include methylaminopropylamine, methylaminoethylamine, butylaminopropylamine, butylaminoethylamine, octylaminopropylamine, octylaminoethylamine, dodecylaminopropylamine, dodecylaminoethylamine, hexadecylaminopropylamine, hexadecylaminoethylamine, octadecylaminopropylamine, octadecylaminoethylamine, isopropyloxypropyl-1,3-diaminopropane, and octyloxypropyl-1,3-diaminopropane. Mono-alkylated alkylene diamines derived from fatty acids may also be used. Examples include N-coco alkyl-1,3-propanediamine (Duomeen® C), N-tall oil alkyl-1,3-propanediamine (Duomeen® T) and N-oleyl-1,3-propanediamine (Duomeen® O), all commercially available from Akzo Nobel.

Sources of molybdenum for incorporation into the fatty oil/diamine complex are generally oxygen-containing molybdenum compounds include, similar to those above, ammonium molybdates, sodium molybdate, molybdenum oxides and mixtures thereof. One suitable molybdenum source comprises molybdenum trioxide ($MoO_3$).

Nitrogen-containing molybdenum compounds which are commercially available include, for example, Sakuralube® 710 available from Adeka which is a molybdenum amine compound, and Molyvan® 855, available from R. T. Vanderbilt.

The nitrogen-containing molybdenum compound may be present in the lubricant composition at 0.005 to 2 wt. % of the composition, or 0.01 to 1.3 wt. %, or 0.02 to 1.0 wt. % of the composition. The molybdenum compound may provide the lubricant composition with 0 to 1000 ppm, or 5 to 1000 ppm, or 10 to 750 ppm 5 ppm to 300 ppm, or 20 ppm to 250 ppm of molybdenum.

Demulsifiers

Demulsifiers useful herein include trialkyl phosphates, and various polymers and copolymers of ethylene glycol, ethylene oxide, propylene oxide, and mixtures thereof.

Seal Swell Agents

Seal swell agents useful herein include sulfolene derivatives, such as Exxon Necton-37™ (FN 1380) and Exxon Mineral Seal Oil™ (FN 3200).

Example Lubricating Compositions

An engine lubricant composition in different embodiments may have a composition as illustrated in Table 1. All additives are expressed on an oil-free basis.

TABLE 1

Example Lubricating Compositions

| | Embodiments (wt. %) | | |
|---|---|---|---|
| Additive | A | B | C |
| Ionic Borate Compound | 0.025 to 4 | 0.05 to 1.8 | 0.1 to 0.8 |
| Friction Modifier | 0.01 to 6 | 0.05 to 4 | 0.1 to 2 |
| (Borated) Dispersant | 0 to 12 | 0.5 to 8 | 1 to 6 |
| Overbased Detergent | 0 to 9 | 0.5 to 8 | 1 to 5 |
| Corrosion Inhibitor | 0.05 to 2 | 0.1 to 1 | 0.2 to 0.5 |
| Antioxidant | 0.1 to 13 | 0.1 to 10 | 0.5 to 5 |
| Antiwear Agent | 0.1 to 15 | 0.1 to 10 | 0.3 to 5 |
| Viscosity Modifier | 0 to 10 | 0.5 to 8 | 1 to 6 |
| Other Performance Additives | 0 to 10 | 0 to 8 | 0 to 6 |
| Synthetic Ester Base Fluid | 0 to 50 | 0 to 35 | 1 to 25 |
| Oil of Lubricating Viscosity | Balance to 100% | | |

Use of the Lubricating Composition

The end use of the lubricant composition described herein includes but not limited to engine oils, including those used for passenger car, heavy, medium and light duty diesel vehicles, large engines, such as marine diesel engines, small engines such as motorcycle and 2-stoke oil engines, driveline lubricants, including gear and automatic transmission oils, and industrial oils, such as hydraulic lubricants.

An exemplary method of lubricating a mechanical device includes supplying the exemplary lubricating composition to the device. The mechanical device may include an engine of a vehicle or a driveline device, such as a manual transmission, synchromesh gear box, or axle.

In one embodiment, a use of the ionic boron compound described herein to improve one or more of seals rating, TBN, TBN retention, oxidation and deposits performance while maintaining one or more of good corrosion and dispersancy performance is provided.

In one embodiment, a method of lubricating an internal combustion engine includes supplying to the internal combustion engine a lubricating composition as disclosed herein. Generally, the lubricating composition is added to the lubricating system of the internal combustion engine, which then delivers the lubricating composition to the critical parts of the engine, during its operation, that require lubrication.

The component(s) of an internal combustion engine to be lubricated by the exemplary lubricating composition may have a surface of steel or aluminum (typically a surface of steel), and may also be coated for example, with a diamond like carbon (DLC) coating. An aluminum surface may comprise an aluminum alloy that may be a eutectic or hyper-eutectic aluminum alloy (such as those derived from aluminum silicates, aluminum oxides, or other ceramic materials). The aluminum surface may be present on a cylinder bore, cylinder block, or piston ring formed of an aluminum alloy or aluminum composite.

The internal combustion engine may or may not have an Exhaust Gas Recirculation system. The internal combustion engine may be fitted with an emission control system or a turbocharger. Examples of the emission control system include diesel particulate filters (DPF), or systems employing selective catalytic reduction (SCR).

The internal combustion engine may be a diesel-fueled engine (such as a heavy duty diesel engine), a gasoline-fueled engine, a natural gas-fueled engine, a mixed gasoline/alcohol-fueled engine, or a biodiesel-fueled engine. The internal combustion engine may be a 2-stroke or 4-stroke engine. Suitable internal combustion engines include marine diesel engines, aviation piston engines, low-load diesel engines, and automobile and truck engines. In one embodiment the internal combustion engine is a gasoline direct injection (GDI) engine.

The internal combustion engine is distinct from gas turbine. In an internal combustion engine, individual combustion events which through the rod and crankshaft translate from a linear reciprocating force into a rotational torque. In contrast, in a gas turbine (which may also be referred to as a jet engine) it is a continuous combustion process that generates a rotational torque continuously without translation and can also develop thrust at the exhaust outlet. These differences result in the operation conditions of a gas turbine and internal combustion engine different operating environments and stresses.

The lubricating composition for an internal combustion engine may be suitable for use as an engine lubricant irrespective of the sulfur, phosphorus or sulfated ash (ASTM D-874) content. The sulfur content of the lubricating composition, which is particularly suited to use as an engine oil lubricant, may be 1 wt. % or less, or 0.8 wt. % or less, or 0.5 wt. % or less, or 0.3 wt. % or less. In one embodiment, the sulfur content may be in the range of 0.001 wt. % to 0.5 wt. %, or 0.01 wt. % to 0.3 wt. %. The phosphorus content may be 0.2 wt. % or less, or 0.12 wt. % or less, or 0.1 wt. % or less, or 0.085 wt. % or less, or 0.08 wt. % or less, or even 0.06 wt. % or less, 0.055 wt. % or less, or 0.05 wt. % or less. In one embodiment, the phosphorus content may be 100 ppM to 1000 ppm, or 200 ppm to 600 ppm. The total sulfated ash content may be 2 wt. % or less, or 1.5 wt. % or less, or 1.1 wt. % or less, or 1 wt. % or less, or 0.8 wt. % or less, or 0.5 wt. % or less, or 0.4 wt. % or less. In one embodiment, the sulfated ash content may be 0.05 wt. % to 0.9 wt. %, or 0.1 wt. % to 0.2 wt. % or to 0.45 wt. %. In one embodiment, the lubricating composition may be an engine oil, wherein the lubricating composition may be characterized as having at least one of (i) a sulfur content of 0.5 wt. % or less, (ii) a phosphorus content of 0.1 wt. % or less, (iii) a sulfated ash content of 1.5 wt. % or less, or combinations thereof.

EXAMPLES

The invention will be further illustrated by the following examples, which set forth particularly advantageous embodiments. While the examples are provided to illustrate the invention, they are not intended to limit it.

All reactants and additives are expressed by weight on an oil-free basis, unless otherwise noted.

Example 1: Salicylic Acid/Tris(2-ethylhexyl)borate/polyisobutylene Succinimide-Based Ionic Tetrahedral Borate Compound A mixture comprising an ionic tetrahedral borate compound is formed from a mixture of salicylic acid (1.26 g), tris(2-ethylhexyl) borate (3.63 g), and a 100 TBN direct alkylation polyisobutylene succinimide (DA PIBSA) dispersant (containing 14% diluent oil) (5.11 g) at a salicylic acid:B:TBN molar ratio of 1:1:1. The DA PIBSA dispersant is made from a 1000 Mn high vinylidene polyisobutylene and maleic anhydride having an NICO (m) ratio of 1.79 and a TBN of 100. The reaction is carried out at 80° C. for 2 hours. The product is isolated without further purification.

Example 2: Salicylic Acid/Tris(2-ethylhexyl)borate/polyisobutylene Succinimide-Based Ionic Tetrahedral Borate Compound An ionic tetrahedral borate compound-containing mixture is formed as for Example 1, but at the salicylic acid:B:TBN molar ratio of 1:2:2.

Example 3: Salicylic Acid/Tris(2-ethylhexyl)borate/polyisobutylene Succinimide Based Ionic Tetrahedral Borate Compound An ionic tetrahedral borate compound-containing mixture is formed as for Example 1, but at the salicylic acid:B:TBN molar ratio of 2:1:1.

Comparative Example 1: Lubricating Composition with PIBSA Detergent in Heavy Duty Diesel Engine Oil A 15W-40 CJ4 heavy duty diesel engine oil containing 0.75 wt. % of the 100 TBN DA PIBSA dispersant (used in Example 1) is used as a baseline for comparison. The 15W-40 CJ4 diesel engine oil also contains other components including overbased calcium sulfonate detergent, zinc dialkyldithiophosphate, ashless antioxidant, ashless succinimide dispersant, foam inhibitors, viscosity index improvers, pour point depressants, and Group III mineral oil. The baseline dispersant was an ashless dispersant with TBN=100 mg KOH/g sample made from 1000 Mn DA PIBSA and triethylene tetraamine.

Example 4: Lubricating Composition with Salicylic Acid-based Ionic Tetrahedral Borate-Pibsa Detergent in Heavy Duty Diesel Engine Oil A 15W-40 CJ4 heavy duty diesel engine oil is prepared in which all of the 100 TBN DA PIBSA dispersant of Comparative Example 1 is replaced with 1.47 wt. % of the ionic tetrahedral borate compound mixture of Example 1 (an amount equivalent to 0.75% of the 100 TBN DA PIBSA dispersant).

Example 5: Lubricating Composition with Salicylic Acid-Based Ionic Tetrahedral Borate-PIBSA Detergent in Heavy Duty Diesel Engine Oil A 15W-40 CJ4 heavy duty diesel engine oil is prepared in which all of the 100 TBN DA PIBSA dispersant of Comparative Example 1 is replaced with 1.37 wt. % of the ionic tetrahedral borate compound mixture of Example 2 (an amount equivalent to 0.75% of the 100 TBN DA PIBSA dispersant).

Example 6: Lubricating Composition with Salicylic Acid-Based Ionic Tetrahedral Borate-PIBSA Detergent in Heavy Duty Diesel Engine Oil A 15W-40 CJ4 heavy duty diesel engine oil is prepared in which 0.5% (two thirds) of the 100 TBN DA PIBSA dispersant of Comparative Example 1 is replaced with 1.47 wt. % of the ionic tetrahedral borate compound mixture of Example 1 (an amount equivalent to 0.75% of the 100 TBN DA PIBSA dispersant).

Example 7: Lubricating Composition with Salicylic Acid-Based Ionic Tetrahedral Borate-PIBSA Detergent in Heavy Duty Diesel Engine Oil A 15W-40 CJ4 heavy duty diesel engine oil is prepared in which 0.25% (one third) of the 100 TBN DA PIBSA dispersant of Comparative Example 1 is replaced with 1.47 wt. % of the ionic tetrahedral borate compound mixture of Example 1 (an amount equivalent to 0.75% of the 100 TBN DA PIBSA dispersant).

Example 8: Lubricating Composition with Salicylic Acid-Based Ionic Tetrahedral Borate-PIBSA Detergent in Heavy Duty Diesel Engine Oil A 15W-40 CJ4 heavy duty diesel engine oil is prepared in which 0.5% (two thirds) of the 100 TBN DA PIBSA dispersant of Comparative Example 1 is replaced with 1.37 wt. % of the ionic tetrahedral borate compound mixture of Example 2 (an amount equivalent to 0.75% of the 100 TBN DA PIBSA dispersant).

Example 9: Lubricating Composition with Salicylic Acid-Based Ionic Tetrahedral Borate-PIBSA Detergent in Heavy Duty Diesel Engine Oil A 15W-40 CJ4 heavy duty diesel engine oil is prepared in which 0.25% (one third) of the 100 TBN DA PIBSA dispersant of Comparative Example 1 is replaced with 1.37 wt. % of the ionic tetrahedral borate compound mixture of Example 2 (an amount equivalent to 0.75% of the 100 TBN DA PIBSA dispersant).

Example 10:
Catechol/Tris(2-ethylhexyl)borate/polyisobutylene Succinimide-Based Ionic Tetrahedral Borate Compound An ionic tetrahedral borate compound-containing mixture is formed from a mixture of catechol (1.03 g), tris(2-ethylhexyl) borate (3.72 g), and the 100 TBN direct alkylation polyisobutylene succinimide (DA PIBSA) dispersant used for Example 1 (5.25 g) at a catechol:B:TBN ratio of 1:1:1. The reaction is carried out at 80° C. for 2 hours. The product is isolated without further purification as a brown oily liquid.

Example 11:
Catechol/tris(2-ethylhexyl)borate/polyisobutylene Succinimide-Based Ionic Tetrahedral Borate Compound An ionic tetrahedral borate compound-containing mixture is formed from a mixture of catechol, tris(2-ethylhexyl) borate, and the 100 TBN direct alkylation polyisobutylene succinimide (DA PIBSA) dispersant used for Example 1, as described for Example 10, at a catechol:B:TBN ratio of 1:2:2.

Example 12:
Catechol/tris(2-ethylhexyl)borate/polyisobutylene Succinimide-Based Ionic Tetrahedral Borate Compound An ionic tetrahedral borate compound-containing mixture is formed from a mixture of catechol, tris(2-ethylhexyl) borate, and the 100 TBN direct alkylation polyisobutylene succinimide (DA PIBSA) dispersant used for Example 1, as described for Example 10, at a catechol:B:TBN ratio of 2:1:1.

Example 13: Lubricating Composition with Catechol-Based Ionic Tetrahedral Borate-PIBSA Detergent in Heavy Duty Diesel Engine Oil A 15W-40 CJ4 heavy duty diesel engine oil is prepared in which all of the 100 TBN DA PIBSA dispersant of Comparative Example 1 is replaced with 1.36 wt. % of the ionic tetrahedral borate compound mixture of Example 10 (an amount equivalent to 0.75% of the 100 TBN DA PIBSA dispersant).

Example 14: Lubricating Composition with Catechol-Based Ionic Tetrahedral Borate-PIBSA Detergent in Heavy Duty Diesel Engine Oil A 15W-40 CJ4 heavy duty diesel engine oil is prepared in which all of the 100 TBN DA PIBSA dispersant of Comparative Example 1 is replaced with 1.43 wt. % of the ionic tetrahedral borate compound mixture of Example 11 (an amount equivalent to 0.75% of the 100 TBN DA PIBSA dispersant).

Example 15: Lubricating Composition with Catechol-Based Ionic Tetrahedral Borate-PIBSA Detergent in Heavy Duty Diesel Engine Oil A 15W-40 CJ4 heavy duty diesel engine oil is prepared in which all of the 100 TBN DA PIBSA dispersant of Comparative Example 1 is replaced with 1.58 wt. % of the ionic tetrahedral borate compound mixture of Example 12 (an amount equivalent to 0.75% of the 100 TBN DA PIBSA dispersant).

Example 16: Lubricating Composition with Catechol-Based Ionic Tetrahedral Borate-PIBSA Detergent in Heavy Duty Diesel Engine Oil A 15W-40 CJ4 heavy duty diesel engine oil is prepared in which 0.5% (two thirds) of the 100 TBN DA PIBSA dispersant of Comparative Example 1 is replaced with 1.36 wt. % the ionic tetrahedral borate compound mixture of Example 10 (an amount equivalent to 0.75% of the 100 TBN DA PIBSA dispersant).

Example 17: Lubricating Composition with Catechol-Based Ionic Tetrahedral Borate-PIBSA Detergent in Heavy Duty Diesel Engine Oil A 15W-40 CJ4 heavy duty diesel engine oil is prepared in which 0.5% (two thirds) of the 100 TBN DA PIBSA dispersant of Comparative Example 1 is replaced with 1.43 wt. % of the ionic tetrahedral borate compound mixture of Example 11 (an amount equivalent to 0.75% of the 100 TBN DA PIBSA dispersant).

Example 18: Lubricating Composition with Catechol-Based Ionic Tetrahedral Borate-PIBSA Detergent in Heavy Duty Diesel Engine Oil A 15W-40 CJ4 heavy duty diesel engine oil is prepared in which 0.5% (two thirds) of the 100 TBN DA PIBSA dispersant of Comparative Example 1 is replaced with 1.36 wt. % of the ionic tetrahedral borate compound mixture of Example 10 to provide a total amount equivalent to 0.75% of the 100 TBN DA PIBSA dispersant.

Example 19: Lubricating Composition with Catechol-Based Ionic Tetrahedral Borate-PIBSA Detergent in Heavy Duty Diesel Engine Oil A 15W-40 CJ4 heavy duty diesel engine oil is prepared in which 0.25% (one third) of the 100 TBN DA PIBSA dispersant of Comparative Example 1 is replaced with 1.43 wt. % of the ionic tetrahedral borate compound mixture of Example 11 (equivalent to 0.75% of the 100 TBN DA PIBSA dispersant).

Results of tests for dispersancy (by soot handling), seals degradation, oxidation, TBN and TBN retention, panel coker deposits, and corrosion performance for Examples B-G and Comparative Example A are shown in Table 2.

Dispersancy is evaluated by a soot test. The lubricants are stressed by addition of 1 vol. % of a 17.4 M mixture of sulfuric and nitric acids (10:1) (amount of acid calculated to reduce TBN by 11). The acid stressed samples are top treated with 6 wt. % carbon black (soot model) and 5 wt. % diesel fuel. The lubricant mixture is the homogenized in a tissumizer to make a slurry. The slurry is then sonicated to completely disperse the carbon black. The dispersed sample is stored at 90° C. for 7 days while blowing 0.5 cc/min of 0.27% nitrous oxide in air through the sample. 25 microliter aliquots of sample are blotted onto chromatography paper once daily. After curing the filter paper for 2 hours at 90° C., the ratio of the diameter of the internal carbon black containing spot to the external oil spot is measured, averaged over 7 days and reported in the table as soot ratio. Higher soot ratio indicates improved soot dispersion.

Seals degradation is evaluated by fluoroelastomer seals performance (DBL6674 FKM, Mercedes-Benz fluoroelastomer seals bench test), which probes changes in seals tensile strength and rupture elongation parameters after immersion in the lubricating composition at 150° C. for 168 hrs.

Oxidative stability is evaluated with the ACEA E5 oxidation bench test, CEC L-85-99. This is a pressure differential scanning calorimetry (PDSC) method which measures oxidation induction time (OIT). Results are reported as the time (in minutes) until the oil breaks and oxidation begins. Higher values are thus better.

TBN is evaluated in mg KOH/g, as described above. TBN retention performance is evaluated using a modified nitration/oxidation bench test. This test involves the addition of nitric acid and NOx to degrade a fully formulated lubricating oil and is modified to measure TBN at the start and end of test. A sample of 40 g of test oil is stressed with nitric acid and Fe(III) oxidation catalyst. The sample is then heated to 145° C. and bubbled with a mixture of air and NOx for 22 hours. TBN, as measured by ASTM D2896, is measured at the start of test and at end of test (TBN Init. and TBN End). TBN retention is then measured as the difference.

Total Acid number (TAN) is measured according to ASTM D664-11a, "Standard Test Method for Acid Number of Petroleum Products by Potentiometric Titration," ASTM International, West Conshohocken, Pa., 2003, DOI: 10.1520/D0664-11A.

Corrosion performance is evaluated on the basis of copper, tin and lead loss by ASTM D6594-14, "Standard Test Method for Evaluation of Corrosiveness of Diesel Engine Oil at 135° C.," DOI: 10.1520/D6594-14, and ASTM D130-12, "Standard Test Method for Corrosiveness to Copper from Petroleum Products by Copper Strip Test," DOI: 10.1520/D0130-12.

Panel coker deposits are evaluated as follows: the sample, at 105° C., is splashed for 4 hours on an aluminum panel maintained at 325° C. The aluminum plates are analyzed using image analysis techniques to obtain a universal rating. The rating score is based on 100% being a clean plate and 0% being a plate wholly covered in deposit. Higher values are better, e.g., above 12% is acceptable.

TABLE 2

15W-40 Heavy Duty Diesel Oil Formulations containing Salicylate-based Ionic Tetrahedral Borate Compounds and Results

| | Comp. Ex. 1 | Ex. 4 | Ex. 5 | Ex. 6 | Ex. 7 | Ex. 8 | Ex. 9 |
|---|---|---|---|---|---|---|---|
| wt. % baseline dispersant | 0.75 | 0 | 0 | 0.25 | 0.5 | 0.25 | 0.5 |
| Ex. 1 wt. % | 0 | 1.47 | 0 | 1.47 | 1.47 | 0 | 0 |
| Ex. 2 wt. % | 0 | 0 | 1.37 | 0 | 0 | 1.37 | 1.37 |
| Results | | | | | | | |
| Soot dispersancy | 537 | 582 | 530 | NM | NM | NM | NM |
| Seals test: | | | | | | | |
| Vol. change, % | −0.4 | 1 | 0.9 | 0.7 | 0.6 | 0.7 | 0.8 |
| TS Change, % | −33.1 | −8.1 | −24.2 | −27 | −35.7 | −46 | −55 |
| RE Change, % | −34.7 | −28 | −37.6 | −27.3 | −35.7 | −41.6 | −46.7 |
| Overall Seals | Fail | Pass | Pass | Pass | Pass | Pass | — |
| Oxidation: OIT (min.) | 152.7 | 271.8 | 240.5 | 215.4 | 289.1 | 276.3 | 279.6 |
| TBN Init. mg KOH/g | 10.5 | 11.3 | 11.1 | 11.3 | 11.5 | 11.2 | 11.9 |
| TBN End mg KOH/g | 0.9 | 1.7 | 2.3 | 2.6 | 2.2 | 2.1 | 1.5 |
| Coker % | 10 | 19 | 21 | 45 | 38 | 21 | 15 |
| Corrosion: | | | | | | | |
| Copper change ppm | 10 | 11 | 13 | 13 | 7 | 8 | 8 |
| Lead change ppm | 16 | 25 | 32 | 33 | 8 | 19 | 21 |

Table 3 shows results for heavy duty diesel oil formulations containing catechol-based ionic tetrahedral borate compounds.

TABLE 3

15W-40 Heavy Duty Diesel Oil Formulations containing Catechol-based Ionic Tetrahedral Borate Compounds and Results

| | wt. % | | | | | | | |
|---|---|---|---|---|---|---|---|---|
| | Comp. Ex. 1 | Ex. 13 | Ex. 14 | Ex. 15 | Ex. 16 | Ex. 17 | Ex. 18 | Ex. 19 |
| baseline dispersant | 0.75 | 0 | 0 | 0.25 | 0.5 | 0.25 | 0.5 | |
| Ex. 10 | 0 | 1.36 | 0 | 0 | 1.36 | | 1.36 | |
| borate | | 0.535 | | | 0.535 | | 0.535 | |

TABLE 3-continued 15W-40 Heavy Duty Diesel Oil Formulations containing Catechol-based Ionic Tetrahedral Borate Compounds and Results

| | wt. % | | | | | | | |
|---|---|---|---|---|---|---|---|---|
| | Comp. Ex. 1 | Ex. 13 | Ex. 14 | Ex. 15 | Ex. 16 | Ex. 17 | Ex. 18 | Ex. 19 |
| 100 TBN DA dispersant | | 0.752 | | | 0.752 | | 0.752 | |
| Catechol | | 0.073 | | | 0.073 | | 0.073 | |
| Ex. 11 | 0 | 0 | 1.43 | 0 | 0 | 1.43 | 0 | 1.43 |
| borate | | | 0.533 | | | 0.533 | | 0.533 |
| 100 TBN DA dispersant | | | 0.749 | | | 0.749 | | 0.749 |
| Catechol | | | 0.147 | | | 0.147 | | 0.147 |
| Ex. 12 | 0 | 0 | 0 | 1.58 | 0 | 0 | 0 | 0 |
| Borate | | | | 0.535 | | | | |
| 100 TBN DA dispersant | | | | 0.752 | | | | |
| Catechol | | | | 0.296 | | | | |
| | Results | | | | | | | |
| TBN mg KOH/g | 10.4 | 11 | 10.9 | 10.5 | 10.7 | 10.5 | 10.6 | 10.7 |
| Oxidation: OIT (min.) | 150 | 274.3 | 210.9 | 228.7 | 236.1 | 229.8 | 245 | 245.7 |
| Coker % | 14 | 45 | 34 | 18 | 35 | 40 | 23 | 19 |
| RONO2 Height absorbance/cm | 16.8 | 15.8 | 6.9 | 12.8 | 2.2 | 6.3 | 14.4 | 2.8 |
| C═O AREA absorbance | 22.8 | 22.3 | −14.4 | 20.5 | 0.8 | −8.2 | 22.6 | −2.3 |
| D2896 TBN Init., mg KOH/g | 10.5 | 10.4 | 10.9 | 10.5 | 10.7 | 10.5 | 10.6 | 10.7 |
| D2896 TBN End, mg KOH/g | 0.9 | 1.2 | 3.1 | 1.1 | 2 | 1.5 | 1.4 | 1.7 |
| D2896 change, mg KOH/g | 9.6 | 9.2 | 7.8 | 8.8 | 9.3 | 10.4 | 8.8 | 10 |
| D4739 TBN Init., mg KOH/g | 7.4 | 7.3 | 7.3 | 7.1 | 7.4 | 7.4 | 7.4 | 7.4 |
| D4739 TBN End, mg KOH/g | 2.7 | 0 | 1.3 | 1.6 | 0 | 0 | 0 | 0 |
| D4739 change, mg KOH/g | 4.6 | 7.3 | 6 | 5.4 | 7.4 | 7.4 | 7.4 | 7.4 |
| D664 TAN Init., mg KOH/g | 3.2 | 3.6 | 3.5 | 4.5 | 3.6 | 3.7 | 4 | 3.6 |
| D664 TAN End, mg KOH/g | 6.2 | 6.8 | 7 | 6.6 | 6.4 | 6.5 | 6.4 | 6.9 |
| D664 TAN change, mg KOH/g | −3.0 | −3.2 | −3.5 | −2.1 | −2.8 | −2.8 | −2.4 | −3.3 |

The results in Table 2 suggest beneficial effects of whole or partial replacement of the 100 TBN PIBSA dispersant in Comparative Example 1 with the borosalicylate dispersants of Examples 1 and 2. All of the examples, except for Example 9, give significant improvement in seals rating, TBN, TBN retention, oxidation and deposits performance whilst maintaining good corrosion and dispersancy performance compared to the baseline Comparative Example 1. Example 9 gave improvement in TBN, TBN retention, oxidation and deposits performance while maintaining good corrosion and dispersancy performance, but did not improve seals rating, as did the other Examples, as compared to the baseline Comparative Example 1.

The results in Table 3 suggest that all of Examples 13-19 give significant improvement in oxidation resistance, and all except Examples 13 and 19 give improvement in at least one of the following properties: TBN, TBN retention, and panel coker deposits rating.

In addition to the performance benefits demonstrated above, lubricating compositions are also evaluated for blend stability and solubility enhancement.

The lubricating compositions shown in Table 4 are prepared:

TABLE 4

Example Lubricating Compositions

| EXAMPLE | Salicylic Acid | Catechol | Amine | Calcium Detergent | 2-ethylhexyl Borate Ester | Amine Mw |
|---|---|---|---|---|---|---|
| 20 | 22.0 | | 46.3[1] | | 31.7 | >1000 |
| 21 | 10.0 | | 75.5[2] | | 14.5 | >2000 |
| 22 | 6.3 | | 84.7[4] | | 9.0 | >1000 |
| 23 | 6.3 | | 84.7[3] | | 9.0 | >2000 |

TABLE 4-continued

| Example Lubricating Compositions | | | | | | |
|---|---|---|---|---|---|---|
| EXAMPLE | Salicylic Acid | Catechol | Amine | Calcium Detergent | 2-ethylhexyl Borate Ester | Amine Mw |
| 24 | 12.6 | | 51.1[1] | | 36.3 | >1000 |
| 25 | 28.6 | | 30.1[5] | | 41.3 | 277 |
| 26 | 23.1 | | 43.6[6] | | 33.3 | 460 |
| 27 | | 23.66 | 33.7[7] | | 42.6 | 129 |
| 28 | | 20.97 | 41.24[5] | | 37.8 | 277 |
| 29 | | 18.71 | 47.57[1] | | 33.72 | >1000 |
| 30 | | 16.94 | | 52.52[8] | 30.54 | |
| 31 | | 27.16 | | 23.86[9] | 48.97 | |
| 32 | | 28.89 | | 19.03[10] | 52.08 | |
| 33 | 81.3[11] | | | 4.9[10] | 13.8 | |
| 34 | 72.3[12] | | | 7.2[10] | 20.5 | |

[1]100 TBN PIB succinimide dispersant prepared from 1000 Mn polyisobutylene
[2]27 TBN PIB succinimide dispersant prepared from 2000 Mn polyisobutylene
[3]13 TBN PIB succinimide dispersant prepared from 2000 Mn polyisobutylene
[4]Succinimide dispersant made with aromatic amine
[5]Decylanthranilate
[6]Bis-[(di-2-hydroxyethylamine)methyl]dodecylphenol (Mannich amine)
[7]n-Butylamine
[8]85 TBN Calcium alkylbenzene sulfonate detergent
[9]300 TBN Calcium alkylbenzene sulfonate detergent
[10]400 TBN Calcium alkylbenzene sulfonate detergent
[11]48 TAN Alkylated salicylic acid; soluble in mineral oil
[12]80 TAN alkylated salicylic acid; soluble in mineral oil Solubility enhancement is defined as the ratio of soluble salicylic acid/catechol resulting from boron complexation versus uncomplexed salicylic acid/catechol. Solubility enhancement is measured as the increase in total soluble salicylic acid or catechol in mineral oil. Results are shown in Table 5.

TABLE 5

| Solubility Enhancement | | | | | |
|---|---|---|---|---|---|
| EXAMPLE | Treat rate in Mineral Oil | Salicylic acid (wt. %) | Catechol (wt. %) | Solubility Enhancement | Clarity |
| 20 | 1.8 | 0.40 | | 2.67 | Clear |
| 21 | 4.0 | 0.40 | | 2.67 | Clear |
| 22 | 6.4 | 0.40 | | 2.67 | Clear |
| 23 | 6.3 | 0.40 | | 2.67 | Clear |
| 24 | 3.2 | 0.40 | | 2.67 | Clear |
| 25 | 5.0 | 1.43 | | None | Hazy/sediment |
| 26 | 5.0 | 1.15 | | 7.7 | Clear |
| 27 | 5.0 | | 1.18 | none | Hazy/slight trace solid |
| 28 | 3.0 | | 0.63 | 1.4 | Clear/trace solid |
| 29 | 10 | | 1.87 | 4.2 | Clear |
| 30 | 10 | | 1.7 | 3.8 | Clear |
| 31 | 10 | | 2.7 | 6 | Clear |
| 32 | 10 | | 2.9 | 6.4 | Clear |
| 33 | 2.0 | 1.63[11] | | none[11] | Clear |
| 34 | 2.0 | 1.44[12] | | none[12] | Clear |
| 35 (comp) | | 0.1 | | | Clear |
| 36 (comp) | | 0.2 | | | Suspension |
| 37 (comp) | | | 0.4 | | Clear/trace |
| 38 (comp) | | | 0.5 | | Sediment |

The solubility data demonstrate that formation of the tetrahedral borate complex results in significant enhancement in solubility.

Preparation of Catechol Tetraborate Compounds with Trivalent Borate Compounds and Alkyl Amines Example 39: Catechol/Tris(2-ethylhexyl)Amine/Boric Acid-Based Ionic Tetrahedral Borate Compound An ionic tetrahedral borate compound-containing mixture is formed from a mixture of catechol, tris(2-ethylhexyl) amine, and boric acid in a 2:1:1 mole ratio. The mixture is allowed to react at 95-130° C. for 2-8 hours with stirring. The resulting reaction mixture is stripped under reduced pressure at 95-125° C. until no more alcohol is collected to provide the ionic tetrahedral borate compound.

Example 40: Catechol/Armeen 2C(di-cocoamine)/Boric Acid-Based Ionic Tetrahedral Borate Compound An ionic tetrahedral borate compound-containing mixture is formed from a mixture of catechol, Armeen 2C (di-cocoamine: a mixture of C12-C18), and boric acid in a 2:1:1 mole ratio as described in Example 39.

Example 41: Catechol/Tris-isooctylamine/Boric Acid-Based Ionic Tetrahedral Borate Compound An ionic tetrahedral borate compound-containing mixture is formed from a mixture of catechol, tris-isooctylamine, and boric acid in a 2:1:1 mole ratio as described in Example 39.

Example 42: Catechol/Tris(2-ethylhexylamine)/Borate Ester-Based Ionic Tetrahedral Borate Compound An ionic tetrahedral borate compound-containing mixture is prepared by mixing catechol, a borate ester made from 2-propyl-1-heptanol and boric acid, and tris(2-ethylhexylamine) at 80° C. for 2 hours until clear and homogeneous.

Lubricant Examples 43-45: Lubricating Composition with Catechol-Based Ionic Tetrahedral Borate-Amine Detergent in Heavy Duty Diesel Engine Oil A series of 15W-40 engine lubricating compositions in Group II base oil of lubricating viscosity are prepared, each containing a catechol/amine/boric acid-based ionic tetrahedral borate compound (Examples 39-41). In addition to the ionic tetrahedral borate compound, the lubricating compositions further include other conventional additives, including a polymeric viscosity modifier, an ashless succinimide dispersant, overbased detergents, antioxidants (combination of phenolic ester, diarylamine, and sulfurized olefin), zinc dialkyldithiophosphate (ZDDP), as well as other performance additives. The lubricating compositions of Examples 43-45 as well as a baseline blend (Comparative Example 2) are prepared from a common formulation as follows in Table 6. All concentrations are on an oil free (i.e. active basis).

TABLE 6

Lubricating Oil Composition Base Formulation

| Components | Comparative Example 2 15W40 | Comparative Example 3 10W-s0 | Comparative Example 4 15W40 |
|---|---|---|---|
| Base Oil | Balance to 100% | Balance to 100% | Balance to 100% |
| Calcium overbased detergent (Combination of alkylsulfonate and phenate detergents) | 1.84 | 0.99 | 0.99 |
| Magnesium sulfonate detergent | | 0.65 | 0.65 |
| Zinc dialkyldithiophosphate | 0.77 | 0.75 | 1.09 |
| Antioxidants (combination of alkylated diphenolamine, hindered phenol, and sulfurized olefin) | 3 | 3.2 | 3.2 |
| Active Dispersant (2200 Mn PIB succinimide dispersant) | 3.32 | 3.8 | 3.8 |
| Viscosity Modifier | 0.53 | 0.31 | 0.68 |
| Additional additives (including foam inhibitors, surfactant, and soot DVM boosters | 0.8 | 0.6 | 0.9 |
| % Phosphorus | 0.078 | 0.76 | 0.11 |

Results for testing for seals degradation, oxidation, TBN and deposit control for Comparative Example 2 and Examples 43-45 are shown in Table 7.

TABLE 7

Lubricating Compositions and Test Results

| | Comp. Ex. 2 | Ex. 43 | Ex. 44 | Ex. 45 |
|---|---|---|---|---|
| Ex. 39, wt. % | 0 | 1.05 | | |
| Ex. 40, wt. % | 0 | | 1.1 | |
| Ex. 41, wt. % | 0 | | | 1.1 |
| Results | | | | |
| TBN mg KOH/g (D2896) | 9.7 | 11 | 10.7 | 10.8 |
| TBN mg KOH/g (D4739) | 6.3 | 7.1 | 7.5 | 7.5 |
| % sulfated ash (D874) | 0.95 | 0.93 | — | — |
| Seals test: | | | | |
| TS Change, % | −44 | −14 | −44 | −41.1 |
| RE Change, % | −43 | −19 | −58.2 | −65 |
| Oxidation and Deposit: | | | | |
| Oxidation: OIT (min.) | 137 | 210 | 184 | 228 |
| KHT (rating) | 3 | 6 | — | — |

Lubricating Compositions: Examples 46-47 and Comparative Examples 6-10

A series of 10W-30 engine lubricants in Group II base oil of lubricating viscosity are prepared as outlined in Table 8. In addition, to Examples 46 and 47, individual and pair-wise combinations of the three components we also prepared (comparative examples 6-10). The lubricating compositions include other conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives. Lubricating composition Examples 46 and 47, Comparative Examples 5-10 as well as the baseline blend were prepared from a common formulation as described in Table 6 (Comparative Example 3).

The lubricating compositions described in Table 8 are tested to determine TBN, using ASTM procedure D2896 and ASTM D4739. Seals testing is performed with Viton® seal material and the lubricating compositions are evaluated in oxidation bench tests: Pressure Differential Scanning calorimetry (PDSC), & Komatsu Hot Tube (KHT). KHT measures the deposit formation tendency of the lubricating composition at high temperature conditions. In KHT, high rating means better deposit control performance. The KHT test employs heated glass tubes through which a sample lubricating composition is pumped (5 mL total sample), at 0.31 mL/hour for 16 hours, with an air flow of 10 mL/minute. The glass tube is rated at the end of test for deposits on a scale of 0 (very heavy varnish) to 10 (no varnish).

PDSC (L-85-99) evaluates the oxidation resistance of a lubricating oil by measuring the oxidation induction time. A higher value indicates better oxidation resistance. Sulfated ash is measured according to D874-13a: Standard Test Method for Sulfated Ash from Lubricating Oils and Additives, ASTM.

The results obtained for each lubricating composition are summarized in Table 8.

TABLE 8

| Lubricating Compositions and Test Results | | | | | | | | | |
|---|---|---|---|---|---|---|---|---|---|
| | Comp. Ex. 3 | Ex. 46 | Ex. 47 | Comp. Ex 5 | Comp. Ex 6 | Comp. Ex 7 | Comp. Ex 8 | Comp. Ex 9 | Comp. Ex 10 |
| Example 42 | | 2.6 | | | | | | | |
| Catechol | | | 0.59 | 0.59 | | | 0.59 | 0.59 | |
| Borate ester made from 2-propyl-1-heptanol and boric acid | | | 1.07 | | 1.07 | | 1.07 | | 1.07 |
| Tris(2-ethylhexyl) amine | | | 0.94 | | | 0.94 | | 0.94 | 0.94 |
| Results | | | | | | | | | |
| Clarity | C SLT | C | C | C SLT | TS | C SLT | C SLT | Clear | TS |
| TBN mg KOH/g (D2896) | 8.9 | 10.4 | 10.4 | 9.2 | 8.9 | 10.4 | 9.3 | 10.4 | 10.3 |
| TBN mg KOH/g (D4739) | 7.1 | 8.5 | 8.6 | 7.2 | 7.0 | 8.2 | 6.7 | 9.1 | 8.2 |
| % sulfated ash | 0.89 | 0.87 | 0.78 | 0.88 | 0.86 | 0.89 | 0.9 | 0.9 | 0.89 |
| Seals test: | | | | | | | | | |
| TS % Change | −39.7 | −12 | −36 | — | −38.1 | −56.6 | −19.8 | −45.3 | −56.1 |
| RE % Change | −29.9 | −.30 | −47.3 | — | −26.8 | −55.7 | −15.2 | −60.3 | −58.8 |
| Oxidation and Deposit: | | | | | | | | | |
| Oxidation: OIT (min.) | 106 | 200 | 160 | 106 | 208 | 97 | 193 | 102 | 151 |
| KHT (rating) | 2 | 4.5 | 5 | 3.5 | 8 | 0.5 | 5 | 3.5 | 8 |

Clarity Ratings are measured at Room Temperature at 26 weeks; C = Clear, SLT = slight trace sediment, TS = Trace sediment Table 8 suggests that both D4739 boost and improvement (or no-harm) to seals can be achieved using the catechol/tris(2-ethylehexylamine/borate ester (made from 2-propyl-1-heptanol and boric acid)-based ionic tetrahedral borate compound, or by using all three components in the blend. Comparative Example 8 shows improved seals but no TBN boost, while comparative Examples 7, 9, and 10 give D4739 boost but at the expense of worse seals performance.

As can be seen, the only blend in this set of Examples which gives improved D4739 TBN, improved seals performance, oxidation resistance, and KHT, is lubricating oil Example 46, containing the compound of Example 42. The material in lubricating oil Example 47, which contains the three raw materials of catechol, borate ester made from 2-propyl-1-heptanol and boric acid, and Tris-2-ethylhexylamine but without pre-reacting them prior to blending of the finished oil is equivalent to lubricating oil example 46 in TBN, oxidation KHT and ash, and somewhat worse in seals, but still better than any of the other amine-containing formulations without all three components (comparative examples 7, 9, and 10).

Lubricating Composition Example 48-49
Lubricating Composition with Catechol-Based Ionic Tetrahedral Borate-PIBSA Detergent in Heavy Duty Diesel Engine Oil A series of 15W-40 engine lubricating compositions in Group II base oil of lubricating viscosity are prepared containing a catechol/amine/boric acid-based ionic tetrahedral borate compound (Examples 39 and 40), as outlined in Table 9. In addition to the ionic tetrahedral borate compound, the lubricating compositions included other conventional additives including polymeric viscosity modifier, ashless succinimide dispersant, overbased detergents, antioxidants (combination of phenolic ester, diarylamine, and sulfurized olefin), zinc dialkyldithiophosphate (ZDDP), as well as other performance additives. Lubricating composition Examples 48, 49 as well as the baseline blend were prepared from the common formulation shown in Table 6 (comparative Example 4). The results obtained for each lubricating composition are summarized in Table 9.

TABLE 9

| Lubricating Compositions and results | | | |
|---|---|---|---|
| | Comp. Ex. 4 | Ex. 48 | Ex. 49 |
| Ex. 39, wt. % | 0 | 1.06 | |
| Ex. 40, wt. % | 0 | | 1.14 |
| Results | | | |
| TBN mg KOH/g (D2896) | 9.3 | 10.5 | 10.7 |
| TBN mg KOH/g (D4379) | 7.2 | 7.8 | 8.0 |
| % sulfated ash (D874) | 0.98 | 0.93 | 0.92 |
| Seals test: | | | |
| TS Change, % | −29.8 | −6.3 | −32.1 |
| RE Change, % | −26.4 | −10.2 | −29.8 |
| Oxidation and Deposit: | | | |
| Oxidation: OIT (min.) | 157 | 181.5 | 191.4 |
| KHT (rating) | 7 | 5.5 | 6.5 |

The lubricating compositions described in Table 9 are evaluated in oxidation bench tests: Pressure Differential Scanning calorimetry (PDSC), and Komatsu Hot Tube (KHT).

As can be seen, Example 48 gives improved D4739 TBN, seals performance, oxidation resistance and similar KHT vs. the baseline Comparative Example 4. Example 49 also has improved 4739 TBN, oxidation resistance and similar KHT and seals performance compared to Comparative Example 4.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention may be used together with ranges or amounts for any of the other elements.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

What is claimed is:

1. A lubricating composition comprising:

an oil of lubricating viscosity; and an ionic tetrahedral borate compound comprising an ammonium cation and a tetrahedral borate anion which comprises a boron atom, the boron atom having at least one aromatic bidentate di-oxo ligand, and wherein the ammonium cation has a molecular weight of at least 260 g/mol and is derived from a dispersant selected from polyisobutenyl succinimide, polyamine dispersants, and solubilized fatty acid amines.

2. The lubricating composition of claim 1, wherein the ionic tetrahedral borate compound is represented by the formula:

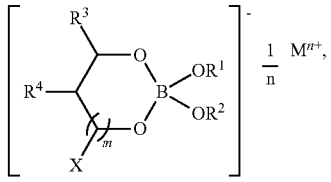

where $R^1$ and $R^2$ are independently selected from hydrocarbyl groups of 1 to 48 carbon atoms or taken together, form a substituted or unsubstituted 5- or 6-membered ring;

$R^3$ and $R^4$ taken together represent a substituted or unsubstituted aromatic ring;

m is 0 or 1;

X is selected from hydrogen, a hydrocarbyl group of 1 to 24 carbon atoms, —$OR^5$, —$NHR^5$, =O, and mixtures thereof, where $R^5$ is a hydrocarbyl group of 1 to 24 carbon atoms;

M represents the ammonium cation; and n is at least 1.

3. The lubricating composition of claim 2, wherein the substituted 5-membered or 6-membered ring is substituted with at least one substituent selected from aliphatic hydrocarbyl groups, aromatic hydrocarbyl groups, aliphatic hydrocarbyl groups comprising at least one heteroatom, aromatic hydrocarbyl groups comprising at least one heteroatom, and combinations thereof.

4. The lubricating composition of claim 2, wherein the ionic tetrahedral borate anion is represented by the formula:

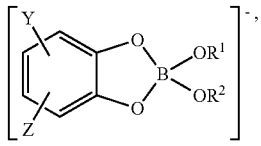

where Y and Z are independently selected from hydrogen, a hydrocarbyl group of 1 to 24 carbon atoms, —$OR^5$, —$NHR^5$, =O, —OH, and mixtures thereof.

5. The lubricating composition of claim 2, wherein the ionic tetrahedral borate anion is represented by the formula:

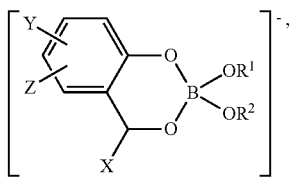

where Y and Z are independently selected from —H, —OH, and hydrocarbyl groups of 1 to 24 carbon atoms, and X' is selected from hydrogen, a hydrocarbyl group of 1 to 24 carbon atoms, —$OR^5$, —$NHR^5$, =O, and mixtures thereof.

6. The lubricating composition of claim 5, wherein when X is =O and wherein the cation in the compound is an ammonium cation with a molecular weight of at least 300 g/mol.

7. The lubricating composition of claim 2, wherein $R^1$ and $R^2$ together form a substituted or unsubstituted 5- or 6-membered ring, the substituted or unsubstituted 5- or 6-membered ring including from 0-2 heteroatoms.

8. The lubricating composition of claim 7, wherein the ionic tetrahedral borate anion is represented by the formula:

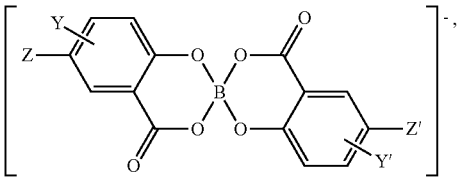

where Y, Z, Y' and Z' are independently selected from H and hydrocarbyl groups of 1 to 24 carbon atoms are independently selected from hydrogen and hydrocarbyl groups of 1 to 24 carbon atoms.

9. The lubricating composition of claim 1, wherein the cation is an ash-free organic cation.

10. The lubricating composition of claim 9, wherein the ammonium cation is derived from a polyisobutenyl succinimide.

11. The lubricating composition of claim 1, wherein the cation M provides the composition with a total base number (TBN) of at least 5.

12. The lubricating composition of claim 1, wherein the ammonium cation has a molecular weight of at least 300 g/mol.

13. The lubricating composition of claim 1, wherein the ammonium cation is derived from an alkyl amine having at least one $C_8$ or higher alkyl group.

14. The lubricating composition of claim 1, wherein the tetrahedral borate compound is at least 0.1 wt. % of the lubricating composition.

15. The lubricating composition of claim 1, further comprising at least one of the group consisting of detergents, antioxidants, additional dispersants, antiwear agents, friction modifiers, and combinations thereof.

16. A method of lubricating a mechanical device comprising supplying to the device the lubricating composition of claim 1.

17. A method of forming a lubricating composition comprising:

reacting a 1,2- or 1,3-dioxo chelate with a trivalent borate compound and a basic component to form a reaction product, the basic component comprising an alkyl amine having at least two $C_8$ or higher alkyl groups and providing the reaction product with a total base number of at least 5, and combining the reaction product with an oil of lubricating viscosity.

18. The method of claim 17, wherein the basic component comprises an alkyl amine with a molecular weight of at least 260 g/mol.

19. The method of claim 17, wherein the 1,2- or 1,3-dioxo chelate is selected from:

glycerol monooleate,

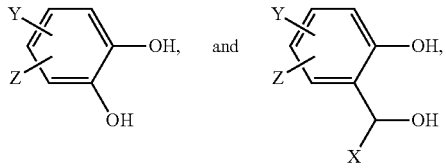

where X is selected from hydrogen, a hydrocarbyl group of 1 to 24 carbon atoms, —$OR^5$, —$NHR^5$, =O, and mixtures thereof, where $R^5$ is a hydrocarbyl group of 1 to 24 carbon atoms; and Y and Z are independently selected from hydrogen, a hydrocarbyl group of 1 to 24 carbon atoms, —$OR^5$, —$NHR^5$, =O, —OH, and mixtures thereof.

20. A lubricating composition comprising an oil of lubricating viscosity and an ionic tetrahedral borate compound which is a reaction product of:

a) a 1,2- or 1,3-dioxo chelate, b) a trivalent borate compound, and c) a basic component which provides the reaction product with a total base number of at least 5, the basic component comprising an alkyl amine having at least one $C_8$ or higher alkyl group;

wherein at least a portion of the boron in the mixture is converted to a tetravalent borate anion.

21. A lubricating composition comprising:

an oil of lubricating viscosity; and a reaction product of a trivalent borate compound, a 1,2- or 1,3-dioxo chelate, and an alkyl amine having at least two $C_8$ or higher alkyl groups.

22. The lubricating composition of claim 21, wherein a molar ratio of the 1,2- or 1,3-dioxo chelate to trivalent borate compound used in forming the reaction product is from 4:1 to 1:2 and/or the molar ratio of the trivalent borate compound to alkyl amine used in forming the reaction product is from 1:2 to 2:1.

* * * * *